US006645256B2

(12) United States Patent
Sanduja et al.

(10) Patent No.: US 6,645,256 B2
(45) **Date of Patent: *Nov. 11, 2003**

(54) POLYMER GRAFTED COTTON

(75) Inventors: Mohan L. Sanduja, Flushing, NY (US); Carl Horowitz, Brooklyn, NY (US); Izabella Zilbert, Brooklyn, NY (US); Paul Thottathil, New Hyde Park, NY (US); Gerald L. Williamson, Greensboro, NC (US)

(73) Assignee: Healthtex Apparel Corp., Wilmington, DE (US)

( * ) Notice: Subject to any disclaimer, the term of this patent is extended or adjusted under 35 U.S.C. 154(b) by 205 days.

This patent is subject to a terminal disclaimer.

(21) Appl. No.: 09/825,283

(22) Filed: Apr. 4, 2001

(65) Prior Publication Data

US 2003/0074740 A1 Apr. 24, 2003

(51) Int. Cl.[7] ..... D06M 14/04

(52) U.S. Cl. ..... 8/115.55; 8/115.66; 8/115.7; 8/115.6; 8/194; 8/195; 8/196; 8/181; 8/193; 8/115.64; 8/115.65; 8/116.67; 8/115.56; 8/192; 8/185; 8/182; 8/184; 8/186; 8/187; 8/188; 427/261; 427/302; 427/303; 427/322; 430/31

(58) Field of Search ..... 427/261, 302, 427/303, 322; 430/31; 8/115.66, 115.7, 115.6, 194, 195, 196, 181, 193, 115.64, 115.65, 116.67, 115.56, 192, 185, 182, 184, 186, 187, 188

(56) References Cited

U.S. PATENT DOCUMENTS

| | | | | | |
|---|---|---|---|---|---|
| 2,789,030 | A | | 4/1957 | Fetscher | 8/120 |
| 2,952,892 | A | | 9/1960 | Stump | 28/74 |
| 3,236,584 | A | | 2/1966 | Degering | 8/116 |
| 3,475,357 | A | | 10/1969 | Kuzmak | 260/17.4 |
| 3,642,428 | A | | 2/1972 | Getchell et al. | 8/116.3 |
| 3,989,454 | A | | 11/1976 | Arthur, Jr. et al. | 8/120 |
| 4,067,688 | A | | 1/1978 | Payet | 8/116.4 |
| 4,090,844 | A | | 5/1978 | Rowland | 8/120 |
| 4,476,182 | A | | 10/1984 | Fink et al. | 428/265 |
| 4,524,093 | A | | 6/1985 | Devry | 427/389.9 |
| 4,549,880 | A | | 10/1985 | Hendrix et al. | 8/115.52 |
| 4,589,964 | A | * | 5/1986 | Mayhan et al. | 522/85 |
| 4,613,333 | A | | 9/1986 | Hendrix et al. | 8/115.7 |
| 4,705,526 | A | | 11/1987 | Abel et al. | 8/555 |
| 4,865,886 | A | | 9/1989 | Itoh et al. | 427/342 |
| 4,901,389 | A | | 2/1990 | Poulenard et al. | 8/115.63 |
| 5,055,541 | A | | 10/1991 | Floyd et al. | 527/300 |
| 5,116,927 | A | | 5/1992 | Floyd et al. | 527/300 |
| 5,158,575 | A | | 10/1992 | Czech | 8/116.1 |
| 5,232,748 | A | * | 8/1993 | Horowitz et al. | 427/553 |
| 5,391,400 | A | | 2/1995 | Yang | 427/389.9 |
| 5,407,728 | A | * | 4/1995 | Kerr et al. | 428/195 |
| 5,486,210 | A | * | 1/1996 | Kerr et al. | 8/115.66 |
| 5,552,472 | A | | 9/1996 | Kerr et al. | 524/500 |
| 5,614,591 | A | | 3/1997 | Basinger et al. | 525/163 |
| 5,667,848 | A | | 9/1997 | Wuestefeld et al. | 427/389.9 |
| 5,741,548 | A | * | 4/1998 | Sanduja et al. | 427/261 |
| 5,763,022 | A | | 6/1998 | Lumpp et al. | 427/389.9 |
| 5,869,589 | A | | 2/1999 | Raynolds et al. | 526/320 |
| 5,885,303 | A | | 3/1999 | Payet | 8/116.4 |
| 5,951,719 | A | | 9/1999 | Cooper et al. | 8/442 |
| 5,976,196 | A | | 11/1999 | Cooper et al. | 8/442 |
| 6,024,823 | A | | 2/2000 | Rubin et al. | 156/278 |
| 6,048,955 | A | | 4/2000 | Wade | 526/342 |
| 6,102,973 | A | * | 8/2000 | Morales | 8/185 |
| 6,174,568 | B1 | | 1/2001 | Kohlhammer et al. | 427/389 |

OTHER PUBLICATIONS

Mileo et al., "Grafting of Methylmethacrylate on Cellulose by Means of Peracids in the Presence of Cupric and Ferric Ions as Catalysts," *J. Polymer Sci. A–I*, 1966, pp. 713–716 (Abstract).

* cited by examiner

*Primary Examiner*—Charles Boyer
(74) *Attorney, Agent, or Firm*—Pennie & Edmonds LLP

(57) ABSTRACT

A solution for forming a graft substrate containing a graft initiator, a catalyst for activating the graft initiator, a polymerizable silicon softener, and at least one additional prepolymer, each of the softener and the prepolymer which includes a functional group for reaction with an activated site on the substrate for grafting thereto and water. The treated fiber exhibits excellent crockfastness, color fastness, and abrasion resistance, and has a soft hand.

55 Claims, No Drawings

POLYMER GRAFTED COTTON

This application is related to the following U.S. patent applications all having the same inventors and all being filed on even date herewith: (1) U.S. application Ser. No. 09/824,732 entitled "Polymer-Grafted Stretchable Cotton", and (2) U.S. application Ser. No. 09/825,287 entitled "Polymer For Printed Cotton", both of which are incorporated herein by reference thereto.

FIELD OF THE INVENTION

The present invention relates to the field of graft polymer coatings, especially as applied to cotton and cotton polyester fibers and fabrics, for properties of crocking, color-fastness, shrinkage, abrasion-resistance, stain-resistance, and hand. In certain embodiments the invention also relates to adding stretch recovery to cotton and cotton polyester fibers and fabrics.

BACKGROUND OF THE INVENTION

Fabrics used in children's apparel should have characteristics such as softness, excellent colorability, color fastness, and acceptable crocking. Furthermore, it is advantageous that the apparel be somewhat stain-resistant. Many consumers prefer cotton, both because it is a natural fiber and because it is typically soft. Fabrics used in children's apparel and in similar applications, however, typically exhibit inferior performance in terms of crocking, abrasion resistance, color fastness, stain resistance, and shrinkage.

Cost is an important factor in children's clothes. The material processing and dying processes used in the manufacture of children's apparel is different than those used for applications such as adult apparel. For example, children's apparel may be printed with a combination of pigments and an adhesive gum, in contrast to the more expensive reactive dyes used in adult clothing. A fixing agent is typically used to improve fastness because the colorant pigments do not readily migrate into cellulose fibers or fix onto them. Soft polymeric adhesive binders or resins are used as fixing agents. Other useful fixing agents include alum, caseins, starches, acrylics, rosin sizes, polyvinyl alcohols, and cationic colorant fixatives. They improve durability by encapsulating and binding pigment to fiber surfaces. Binders and resins only modestly improve durability because they are a surface treatment and generally have only moderate fastness. Binders or resins also stiffen textile-like aesthetics while often having a negative impact on liquid distribution and absorbency properties.

Crocking is a transfer of color from the surface of a colored fabric to an adjacent area of the same fabric or to another surface principally by rubbing action. Crockfastness is color fastness to rubbing. Deeper shades of color require excess pigment and binder or resin that tend to rub off or crock. To obtain a navy blue color with acceptable crocking using this dying process results in an unacceptably stiff garment. Improving crockfastness/colorfastness of dyed textile fabrics has been an ongoing problem in the textile industry.

Current techniques to improve one or more characteristics, for example crocking, results in diminished performance at least in terms of hand and also usually in terms of shrinkage. Furthermore, the treatments exhibit poor fastness to the fabric during washings.

It is known to graft certain chemicals on to cotton fiber. U.S. Pat. No. 2,789,030 discusses a method of modifying a cellulose fabrics with acrylate monomers, modified by glyoxals. U.S. Pat. No. 3,989,454 teaches grafting acrylate, especially ethyl acrylate monomers, onto cotton and mercerized cotton using high energy gamma radiation as an initiator and a water/methanol as the solvent. U.S. Pat. No. 4,901,389 teaches a grafting reaction for a fiber material where free radicals are formed, and then adding fluorinated monomers, particularly fluorinated acrylates, which are grafted. The graft is beneficially aided by adding a graftable derivative of morpholine, i.e., the morpholinoethyl acrylate. U.S. Pat. No. 4,737,156 discloses use of cationic cellulose graft copolymers for improving dye fastness to a dyed textile substrate by post dye application (top up). U.S. Pat. No. 4,524,093 discloses a latex coating composition of an emulsion of acrylate monomers and a glyoxal curing resin.

One method to improve the hand is to treat the fabric with a softener. The use of silicones for softening fabrics, i.e., providing lubrication between fibers and yarns so they move over one another more easily, has been well known for quite some time. In addition, the use of organomodified silicones for textile treatments has also been well documented over the years (See U.S. Pat. Nos. 4,620,878; 4,705,704; 4,800,026; 4,824,877; 4,824,890; and 5,173,201, each of said patents being incorporated herein by reference. Silicones of this type are typically delivered to textiles in the form of an aqueous emulsion.

Other silicone fluids, for example polydimethylsiloxanes, provide additional benefits such as improved fabric feel. Examples of these preemulsified silicones are 60% emulsion of polydimethylsiloxane (350 cs) sold by Dow Corning Corporation under the trade name DOW CORNING 1157 (TM) Fluid and 50% emulsion of polydimethylsiloxane (10,000 cs) sold by General Electric Company under the trade name General Electric SM 2140 (TM) Silicones. Such compositions are usually added to either the wash or rinse water of a laundering operation. They are typically aqueous based, water dispersible microemulsions which contain from about 0.1% to about 15% of the microemulsified functional silicones. The compositions are diluted in the wash or rinse.

U.S. Pat. No. 5,616,758 describes cationic silicone compositions that can be employed as a lubricant for fibers such as polyester, nylon, acrylic, aramides, cotton, wool, and blends thereof. The use of silicone compounds in the treatment of synthetic fibers is known in the art. See, for example, the discussion of epoxy silicones in U.S. Pat. No. 2,947,771. Such silicone compounds are effective in both providing increased lubricity of the fiber and improved softness for fabrics made from these fibers. However, epoxy silicones suffer from the disadvantage that they only possess a limited durability when employed with synthetic fibers.

The art has also looked to certain aminosilicones in the treatment of fibers. Because these silicones possess no net charge, they cannot effectively cling, generally by electrical attraction to cellulosic or proteinaceous materials. In fact, when used in connection with conventional polyester fiber/cotton blends, the aminosilicones will cling only to the polyesters within the blends. In an attempt to overcome these problems, it is known to use cationic compounds which are adhere to the cellulosic materials. Certain cationic compounds such as certain specific cationic polyorganodisiloxanes (see, for example, U.S. Pat. No. 4,472,566) and quaternary nitrogen derivatives of organosiloxanes (such as those discussed within U.S. Pat. No. 4,185,087) are known in the art. Other suitable fabric softening compounds are the nonquatemary amides and the nonquatemary amines. A commonly cited material is the reaction product of higher fatty acids with hydroxy alkyl alkylene diamines. See U.S. Pat. Nos. 4,460,485; 4,421,792; and 4,327,133.

U.S. Pat. No. 2,952,892 describes a method of modifying cellulosic fibers with a composition including acrylic prepolymers and silicone resins such as alkyl polysiloxanes. U.S. Pat. No. 5,951,719, the disclosure of which is incorporated by reference, discloses a method of treating a cellulose fabric with a composition containing acrylates, glyoxals, and silicone textile softeners to improve colorfastness on dyed cotton U.S. Pat. No. 5,741,548, the disclosure of which is incorporated by reference, teaches a process of chemically bonding a polymeric coating, that is, acrylic prepolymers, urethane prepolymers, and acrylic urethanes, to many fibers, including cellulosic cotton. This patent describes the use of graft initiators such as iron salts and peroxides such as urea peroxide. The purpose of the graft is to provide a surface capable of binding ink-jet printing for high resolution imaging.

U.S. Pat. No. 5,552,472, the disclosure of which is incorporated by reference, teaches a solution for forming a grafted substance containing an initiator, a catalyst, a water-dispersible prepolymer, and a monomer. The graft controls fabric porosity, and is useful for controlling the permeability of air bags. One composition contains a graft initiator, for example a metal ion; a catalyst, for example peroxide, peracid, or perbenzoate; a grafting prepolymer, for example water-dispersible urethanes; and a monomer, for example acrylic.

U.S. Pat. No. 5,763,557, the disclosure of which is incorporated by reference, teaches a polymeric composition which is applied by chemical grafting that involves the use of monomers/prepolymers, catalyst, graft initiator and other ingredients of the composition. The coating is beneficially applied to reemay and satin acetate fabric allows to undergo graft polymerization thereby forming a polymeric film which is chemically bonded to the fabric substrate with strong adhesion. The preferred composition contains a graft initiator, for example a metal ion; a catalyst, for example a peroxide; a grafting prepolymer, for example urethane and/or acrylic; a monomer, for example acrylic; and a sodium salt of AMPS monomer.

U.S. Pat. No. 6,165,919 teaches a process whereby cellulosic materials such as cotton fabrics and paper are crosslinked with a composition comprising (A) polymers of ethylenically unsaturated polycarboxylic acid monomers or salts thereof, the monomers having one or more dicarboxylic groups wherein the carboxyl groups are on adjacent carbon atoms; (B) saturated alpha-hydroxypolycarboxylic acids or salts thereof; and (C) one or more curing catalysts, and heated to produce esterification and crosslinking of the celluose by reaction of the cellulosic hydroxyl groups with carboxyl groups in the reaction product of (A) and (B).

Treatments of paper with formaldehyde-based reagents, such as dimethyloldihydroxylethyleneurea, urea-formaldehyde, and melamine-formaldehyde, have been used as wet strength agents to impart these valuable characteristics on cellulosic fiber. However, formaldehyde is an irritant and a known carcinogen. In addition, cellulosic fabrics treated with formaldehyde-based reagents suffer severe strength loss. As a result there are stringent limits on the formaldehyde-production from textile garments. Glyoxylated polyacrylamide-diallyldimethyl ammonium chloride copolymer resins are also known for use as dry strength and temporary wet strength resins for paper.

The art teaches many formulations for increasing colorfastness, improving hand, and reducing shrinkage. What is needed is an inexpensive composition and process whereby fabric, especially for cotton and cotton-poly blends, can be readily treated to reduce crocking, increase color fastness, reduce shrinkage, wherein such treatment does not adversely affect the hand. Preferably, the treatment can endure at least 20 washing cycles with little degradation in performance. Preferably, the treatment that can be applied without adding special processing steps to the fabric. The treatment beneficially is in a single stable composition with a shelf life of at least two months. The compositions of the present invention solve these needs.

SUMMARY OF THE INVENTION

The present invention is directed toward compositions and methods to improve stain resistance, color fastness, crock-fastness, shrinkage, and abrasion resistance of textile fibers while not adversely affecting the hand of the textile products. The compositions are formulations that include specific mixtures of monomers (as used herein these are prepolymers), prepolymers, catalysts, initiators, crosslinkers, and silicone softeners in specific formulations. The composition, when applied to a textile, preferably a cotton textile, develops a graft polymerization, thereby forming a polymeric film over at least a portion of the fibers that is covalently bonded to the fibers.

The composition can be applied to fibers, cloth, textiles, and the like by dipping, spraying, rollercoating, and the like. The composition is beneficially polymerized during conventional heating and drying processes.

One embodiment of the invention relates to a solution for forming a grafted substrate comprising a graft initiator for activating sites on a substrate having active hydrogens; a first component which includes a functional group for reaction with an activated site on the substrate for grafting the first component thereto and for forming an active site on the first component; and a second component which includes a functional group for reacting with an activated site on the substrate or the first component and for forming an active site on the second component. The first and second components are grafted onto the substrate when contacted by the solution to form a grafted substrate; and one of the first and second components comprises a structure which imparts increased softness and stain resistance to the grafted substrate, and the other of the first and second components increases the flexibility of the graft.

In one embodiment, the invention involves treating cotton or cotton-polymer fibers, for example cotton/polyester, with a stable liquid composition comprising activators, catalysts, and at least 5%, more preferably at least 7%, of polymerizable softeners, as well as a sufficient quantity of selected monomers or prepolymers to adhere the softener to the fabric by polymerizing polymers that incorporate the softeners and that are grafted to the substrate fibers.

In another embodiment, the invention relates to stable formulations of treating compositions. The formulations comprise activators, catalysts, and at least 5%, more preferably at least 7%, of polymerizable softeners, as well as sufficient selected monomers to adhere the softener to the fabric by polymerizing polymers that incorporate the softeners. By stable it is meant that the composition remains fluid, and has less than about 5%, preferably less than about 2%, of the prepolymers therein self polymerize, that is, form insoluble/nonsuspendable polymers within the composition during storage at a temperature between about 60° F. and about 90° F. over a period of at least 2 months. The fluid contains activators and catalysts, but these are not active at an appreciable rate until the fluid is exposed to elevated temperatures during a drying and activating process.

In another embodiment, the invention relates to stable concentrates, which can be diluted with water or other solvent to form a stable formulations described above.

Preferred softeners are an aqueous emulsion of silicone oil for cotton fibers, and modified or unmodified organopolysiloxanes for cotton/polyester fibers. In the special case of a printed cotton, which contains pigments adhering to the cotton fibers by means of a gum or other adherent, the preferred softener is a combination of modified or unmodified organopolysiloxanes, high density polyethylene, and polyamide.

DETAILED DESCRIPTION OF PREFERRED EMBODIMENTS

The terms fiber, yarn, filament, staple and fabric are well known to those skilled in the textile art. Also, the finishing and treatment operations referred to are well known. However, as used herein, the term "fiber" refers individual fibers, yarns, staple, and filaments, and also to fabrics, both woven and nonwoven, and to articles made from fibers and/or fabrics.

It is known in the art that both natural and synthetic fibers are utilized in the formation of fabric material. The cellulosic textile fibers come from natural sources such as cotton, flax, esparto grass, milkweed, straw, jute hemp, and bagasse. The compositions of the invention are useful for all natural fibers. Blends, such as cotton/polyester blends, are well known to those skilled in the textile art.

The terms "colorfast" and/or "fastness" refer to the extent that color will fade or change upon exposure to an agent such as, for example, sunlight, reactive gases, chemicals, solvents and the like. Colorfastness or fastness can be measured by standard test methods such as, for example, AATCC Test Method 3-1989.

As used herein, the terms "crock" or "crockfast" refers to the extent that color may be transferred from the surface of a dyed fabric to another surface by rubbing. Crock testing may be carried out utilizing standard test procedures and equipment such as, for example, an AATCC Crockmeter Model CM.5, available from Atlas Electric Devices Co. Chicago, Ill.

As used herein, the term "dyed cotton" and "dyed cotton/polyester" means fibers that have been exposed to and have incorporated at least one reactive dye. Disperse dyes are are used to dye polyester. As used herein, the term "reactive dye" means an acid, basic or mordant dye with an attached reactive group that is capable of covalent bonding to a cellulose fiber. While reactive dyes, vat dyes and sulfur dyes appear desirable for use with cellulose fibers, application of these dyes requires more than one process step and is often hampered by slow line speeds needed to achieve adequate reaction times.

As used herein, the term "printed cotton" and "printed cotton/polyester" means fibers that have been exposed to a pigment and an adherent that helps bind the pigment to the fibers. One such adherent, also called an adhesive gum, is carboxylated butadiene acrylonitrile.

As used herein, the compositions are described by weight percent unless otherwise indicated.

As used herein, the term "catalyst" means a fluid formulation comprising about 0.01N to about 1N solution, preferably a 0.1 N solution, of the active ingredient, for example a peroxide or metabisulfite, typically but not necessarily dissolved in water. Advantageously the catalysts are added to the compositions as a solution.

As used herein, the term "graft initiator" means a fluid formulation comprising about 0.01N to about 1N solution, preferably a 0.1 N solution, of the active ingredient, for example an iron salt, typically but not necessarily dissolved in water. Advantageously the graft initiators are added to the compositions as a solution.

The invention is applicable to the use of any polymerizable monomers such as: vinylidene chloride, chloroprene, isoprene, dimethylaminoethyl methacrylate, styrene, 1,3-butylene dimethyacrylate, hydroxyethyl methaerylate, isobutylvinyl ether, acrylonitrile, acrylamide, N-vinyl pyridine, glycidyl methacrylate; N-vinyl caprolactam, N-vinyl pyrrolidone, N-vinyl carbazole, acrylic acid, methacrylic acid, ethyl acrylate, ethyl methacrylate, itaconic acid, isobutylmethacrylate, methyl acrylate, sodium styrene sulfonate, sodium vinyl ether, divinylether of ethylene glycol, divinyl ether of butanediol, vinyl toluene, vinyl acetate, octadecyl vinyl ether, as well as mixtures and prepolymers thereof. However, certain combinations of monomers and prepolymers have been found to produce fabric with exceptionally good characteristics, including stain resistance, crockfastness, and hand.

Further, the components of the compositions, including acrylic, elastomeric latex, urethane, silicon oil, polyamide, urethane acrylate, polyethylene glycol diacrylate, high density polyethylene, and sodium vinyl sulfonate, refer to compositions of monomers and/or prepolymers, and more particularly to formulations of monomers and prepolymers as they are commercially available. As used herein, the term "prepolymer" encompasses monomers, oligmers, short chain pseudo-stable polymeric chains which can be normally incorporated into a polymerizing polymer, and formulations which may react with other compounds to form a polymerizable monomer or oligomer.

As used herein, the term "acrylic prepolymer" refers to low molecular weight polymer chains of 6000 m.w. or less and preferably from about 200 to 1200 m.w. Monomers especially suited to the practice of the present invention include acrylic monomers including hydroxyl, carboxyl, epoxy, amino, hydride and glycidyl functional groups, i.e., hydroxy ethyl or propyl methacrylate, dimethyl and diethyl amino ethyl acrylates and methacrylate, methyl, ethyl, butyl, and other alkyl acrylates and methacrylates, glycidyl methacrylate, or mixtures thereof. Any of the foregoing monomers can be used alone or in combination in a prepolymer.

Diacrylates and triacrylates are present in at most minor quantities because they may result in undesirable crosslinking.

For example, preferred acrylic prepolymers include HELASTIC WO-8001 (TM), HELASTIC WO-8041 (TM), and HELASTIC WO-8061, available from the Wilmington Leather Co., New Castle, Del. These are characterized by soft tensile strength, adhesion, and color stability. Others include ECCO-REZ 907 available from Advanced Polymer, Saddlebrook, N.Y. It was found that different acrylic prepolymers gave different results, and it the most preferred formulations contain predetermined quantities of several acrylic prepolymers.

The glyoxal resin prepolymer is the formulation commercially available as ECCORE GB 404 (TM), available from Eastern Color & Chemical. More preferred is RESIN KLF (TM) which is a low-formaldehyde producing glyoxal resin.

Several formulations utilize a polymerizable silicone oil, preferably in the form of an aqueous emulsion or microemulsion of silicone oil. The silicone oil-softener is specified by the quantity of the aqueous silicone oil emulsion needed in the formulation. Silicone oils and organopolysiloxanes provide better hand, and also increase abrasion, chemical, and stain resistance.

Nonfunctional and functional siloxanes as characterized above may be monomeric, (low molecular weight), or oligomeric or polymeric (high molecular weight) and either linear, branched or cyclic. Examples of polymeric siloxane compounds include nonfunctional and organofunctional polysiloxanes including dimethylpolysiloxanes, methylhydrogen polysiloxanes, methylalkyl polysiloxanes methylaryl polysiloxanes, methylfluoroalkyl polysiloxanes, and organofunctional methylpolysiloxanes such as aminoalkylmethyl polysiloxane, cyanoalkylmethyl polysiloxane, haloalkylmethyl polysiloxane, and vinylmethyl polysiloxane. Examples of monomeric or oligomeric siloxanes include $MeOSi(Me)_2$—OMe, $Me_3SiOMe$, $Me_3Si(OMe)_2$, $Si(OMe)_4$, $Si(OEt)_4$, $MeSi(Me)_2$—$OSi(Me)_2$—Me, HOOC—$(CH_2)_3$—$Si(Me)_2$—O—$Si(Me)_2$—$(CH_2)_3$—COOH. Examples of cyclic siloxane oligomers include octamethylcyclotetrasiloxane and decamethylcyclopentasiloxane.

The preferred silicone oil emulsion is SEQUASOFT 69 (TM), available from Gen Corp., Chester, S.C. The preferred high molecular weight silicone is HELASTIC WO-8026 (TM), available from the Wilmington Leather Co., New Castle, Del. The preferred modified organopolysiloxane emulsion is APS V-SOFT (TM) available from Advanced Polymer, Saddlebrook, N.Y.

The polyamide prepolymer is a dispersion available as MICROMID 632HPL (TM) from Union Camp, Jacksonville, Fla. The preferred urethane prepolymer is SR 9035 (TM), the preferred urethane acrylate is SR 9035 (TM), and the preferred polyethylene glycol diacrylate prepolymer is SR 344 (TM), each available from Sartomer Co., Pa. Another urethane prepolymer emulsion is RESAMINE UMT 171(TM).

The anti-crocking nonionic dispersant is CROCKFAST 2 (TM) available from Aml Technology, Oxford, N.Y.

The preferred elastomeric latex prepolymer is HISTRETCH V-43 available from B.F. Goodrich, Cleveland, Ohio. These are highly elastic polymers with memory which allows them to recover shape after being stretched. The polyethylene prepolymer emulsion is available as MYKON HD from Gen. Corp, Chester, S.C.

The carboxylyated butadiene acrylonitrile prepolymer is available from Reichold Chemicals, Research Triangle, N.C.

The graft polymer chains are formed from monomers and prepolymers containing appropriate polymerizable functionality, e.g., groups such as hydroxyl, carboxyl, epoxy, amide, amine, a hydride and so forth. The quantity of triacrylates is kept low to reduce unwanted crosslinking.

As used herein, water is typically deionized water. Other components, such as alcohols, alkyl glycols, and other organic solvents, may be used.

It is a primary object of the present invention to provide fiber and fabric material having a coating of polymeric material which is chemically, that is, covalently bonded to the fabric. This invention is applicable to any suitable fabric material, including acetate, polyester, polypropylene fabric, nylon, polyester, fiberglass, acrylic, cellulose, polyethylene, polyvinyl chloride, polycarbonate, and the like. The invention is particularly applicable to cotton and cotton-containing fabrics.

Cotton is a major textile fiber. Typically, it is made of between about 88% and 96% cellulose. Cellulose is a natural carbohydrate high polymer, that is, a polysaccharide, consisting of anhydrous glucose units joined by an oxygen linkage forming essentially linear molecular chains.

This grafting of polymeric material onto fibers is achieved by chemical bonding of the polymers to the fabric substrate molecules through covalent bonding. Grafting of a cotton fabric surface with a polymeric layer can be described as a process comprising activating the cellulose molecule, attaching monomers at the reactive sites, and then chain propagation on the attached monomers.

Chemical grafting is believed to involve, as a first step, the activation of the substrate, i.e., the fabric to be treated. The free radical initiates the process of chemically grafting a polymeric layer onto the fabric surface. The acidic proton from the monomer or from the substrate is removed by the graft initiator, thereby forming a radical. In particular, the process of chemically grafting a polymeric layer to a cotton fabric surface comprises abstraction of the (acidic) hydrogen atom from a hydroxy group of the cellulose molecule forming a free radical. The radical then initiates the formation of polymer chains.

A graft initiator is used to activate the fabric surface and start the polymerization reaction. The graft initiator is selected to abstract an active hydrogen from a substrate filament or yarn to which a graft polymer will be bonded. It is preferred that the initiator is a metal ion provided by the ionization of a metal salt. Ferrous ions derived from ferrous ammonium sulfate, and other metal ions such as $Ag^+$, $Co^{+2}$, and $Cu^{+2}$, derived from their respective salt solutions, have the capacity of removing active hydrogens and concomitantly initiating the growth of polymer chains at the site from where the active hydrogen was removed. Silver ions and ferrous and ferric ions are preferred, though other metal salts may also be advantageously utilized.

The graft initiator beneficially includes an effective concentration of a metal ion selected from $Fe^{+3}$, $Fe^{+2}$, $Ag^+$, $Co^{+2}$, and $Cu^{-2}$. The quantity need not be large, since once a site is activated the propagation continues substantially like an autocatalytic process at that site. Between 1 and 1000 ppm, preferably between 10 and 100 ppm, of a graft initiator is usually sufficient. When ferrous ammonium sulfate is utilized as a graft initiator, such salts are preferably present in the graft composition in an amount of from about 0.001% to about 0.2% by weight of the composition, more preferably between about 0.01% to about 0.1% by weight of the composition. Certain iron salts perform especially well, though they contribute to yellowing and for certain applications may be less preferred.

In one embodiment of the present invention chemical grafting of a natural or polymeric filament or yarn substrate is initiated with the reaction of a graft initiator with an "active hydrogen" of the substrate by a metal ion. Other methods of initiating grafting, including radiation, high or low pH, plasma treatment, or flaming are includes in certain embodiments of the invention, and allow the quantity of graft initiator in the treatment compositions to be reduced or eliminated. The initiator can in one alternative embodiment be ozone or other known free-radical forming agent. In these cases, however, the composition will not be a self-contained single-formulation composition which can be easily applied and cured using equipment and processes in place in yarn and fabric manufacturing plants.

An active hydrogen is a hydrogen which is relatively easily removed from the substrate by the graft initiator. A tertiary carbon, for example, maintains a weaker covalent bond with a hydrogen atom than a secondary carbon, and that hydrogen atom would be one type of active hydrogen. Other types includes N—H, —OH, —COOH, —COOR—H, etc. For the cellulose structure, it is believed that the graft initiator removes the active hydrogen from a cellulose-$CH_2OH$ to form a cellulose-$CH_2O^-$. Graft initiators are able to remove: an active hydrogen alone, resulting in the formation of a cation position; an active hydrogen with one electron resulting in a substrate free radical position; or an active hydrogen and both electrons resulting in the formation of an anion position on the substrate.

Hydrogen abstraction produces an activated position on a substrate which bonds with a monomer or prepolymer, particularly with a vinyl-based monomer. The free radical carbonyl group thereafter reacts with either a first component or a second component (e.g. CH2═CH—X), so as to graft the component as a free radical upon the polyester chain. The grafted free radical component may now, covalently bond to additional components of the same or different species thereby activating additional components to a free radical state, or may react with another free radical to terminate the polymerization process.

It is recognized that not all cellulose-$CH_2OH$ on a polysaccharide chain need be activated. Propagation continues until terminated by, for example, radical combination.

In order to ionize the metal salts to provide an activating metal ion, the graft solution includes a catalyst. As used herein the term catalyst means a substance which transforms a used graft initiator into an entity capable of initiating another graft site. A wide variety of catalysts may be utilized in the method of the present invention. Among the catalysts which can be used include ammonium persulfate, hydrogen peroxide, tert-butylhydroperoxide, ditert-butyl peroxide, benzoyl peroxide, sodium metabisulfite, dicumyl peroxide, lauryl peroxide, tert-butyl perbenzoate and peracetic acid. Other strong oxidizer, including periodate, can also be used. Peroxide, peracid, or a perbenzoate are preferred catalysts. Water soluble peroxide catalysts of urea peroxide and/or hydrogen peroxides are preferred, as are ammonium persulfate and/or potassium persulfate. Benzoyl peroxide, peracetic acid or tertiary butyl perbenzoate are also useful. Certain peroxides, such as urea peroxide, exhibit good stability during storage and good activity during use. The catalyst functions to ionize metal salts such as silver or iron salts described above so as to provide silver and iron ion graft initiators.

The catalyst can be present in any effective quantity. When a peroxide is utilized to activate the graft initiator, such compounds are preferably present in the grafting composition in an amount of from about 0.001% to about 0.2% by weight of the composition, more preferably between about 0.01% to about 0.1% by weight of the composition.

The fabric according to the invention has a grafted polymer layer prepared by a process that includes treating a fabric surface with a graft initiator effective to chemically activate the fabric surface. The chemically activated surface is then (or simultaneously) contacted with a reagent that includes the polymerizable monomers and prepolymers that reacts with the activated fabric surface to form a polymer layer grafted, i.e., chemically bonded, onto the fabric surface.

It is expected that not all of the polymerizable material in the treatment composition will form grafts onto the substrate fiber. Preferably, at least about 20%, more preferably at least about 50%, of the polymerizable material is grafted to the substrate fibers. Evidence of grafting is found when the fibers do not lose more than 50% of the treatment after at least 15 washes with normal detergent.

Of course, the grafted polymers may also be crosslinked to other grafted or non-grafted polymers. It is preferred that at least some of the polymerizable prepolymers have functional side chains, such as hydroxyl groups, carboxyl groups, and secondary or tertiary amino groups. The described formulations were selected to provide a grafted product that improves the feel, shrinkage, stain resistance, color fastness and crock fastness of the treated fiber.

Where possible, the reactions of the invention make use of emulsions or aqueous solutions to minimize environmental release of organic solvents. Toward this end, methods have been developed to solubilize the necessary organic materials in water and maintain a stable fluid composition. In addition, the reactions typically exhaust the organic reactants, leaving little or no organic waste.

The invention relates to forming grafted polymers onto fibers that comprise cotton. The method provided by the present invention for the chemical grafting of the polymer material onto the fabric surface comprises: (a) treating a fabric surface with an effective graft initiator producing a chemically activated fabric surface; (b) contacting the activated fabric surface with a reagent comprising a polymerizable monomer or pre-polymer to produce a polymer layer grafted fabric surface; and (c) terminating the chemical grafting by radical combination or other mechanism after the polymer layer is grafted onto the fabric surface.

Accordingly, the present invention provides a composition and a method for preparing a fabric surface to provide the properties of improved crocking, color fastness, abrasion resistance, stain resistance, and hand, and to also provide a fabric with reduced shrinkage. The polymer material is chemically grafted onto the fabric polysaccharides to form a durable treatment. The grafted polymers advantageously comprise silicone-based softeners and at least two selected prepolymers. Grafting is initiated with a graft initiator.

Other advantages of the present invention is that the formulation is stable at room temperature, is available as a concentrate, and in preferred embodiments has all necessary components in a single fluid composition. The graft initiators and catalysts are activated by heat, for example exposure to about 340° for about one minute. It is advantageous in the textile production that the treatment formulation be self-contained, though it need not necessarily be so. Activation of the cotton fiber with, for example, ozone or irradiation, prior to or concurrent with the wet pickup, is also envisioned as an embodiment of the reaction. In such a case, the formulation without the activator and catalyst will be more stable to temperature variations.

One important aspect of the invention is providing a stable concentrate for use in treating the fiber. Stable one-composition concentrates, wherein all of the ingredients except a solvent are present, are particularly beneficial. The premixing of the concentrate allows for better measurement and control of the resulting treatment formulation. Applicants have found that particular ratios of certain treating compounds, as well as the concentration of the several treating components, are important. Furthermore, a concentrate reduces the cost of shipping and handling the treating chemicals.

The particular monomers and prepolymers used for the invention, and the amount used, depends in part on the properties of the cotton. The properties of the cotton depend on whether or not it has been dyed, pigmented by printing, whether or not the cotton has other adjuvants such as a cotton-poly composition as is known in the art, and so forth.

The absolute quantity of the chemical is less important than the ratios of ingredients in the composition. Certain compounds that provide crosslinking, for example diacrylates, triacrylates, and urethane acrylates, with multiple bonding locations, is included in only small quantities, generally less than 1% of the polymerizable composition, preferably less than 0.4% of the polymerizable composition. Silicon-based softeners, on the other hand, provide at least 20%, preferably at least 30%, and in most cases preferably at least 40% of the polymerizable material.

Dyed Cotton and Un-dyed Cotton

As used herein, "dyed cotton" is cotton that has been reacted with reactive dyes. The dyed cotton therefore needs less protection to maintain anticrocking and colorfast properties. Further, the reactive dyes alter the fiber and a specially tailored treatment composition provides superior combination of very soft hand, good crockfastness and color fastness, and good stain and abrasion resistance.

One aspect of the invention is a method of treating cotton fibers comprising the first step of providing a stable composition comprising between about 0.4% and about 5% of a glyoxal prepolymer; between about 0.1% and about 3% of an elastomeric latex prepolymer; between about 6% and about 35% of an aqueous silicone oil emulsion; between about 0.2% and about 5% of a urethane prepolymer emulsion; between about 0.002% and about 0.3% of a catalyst; and between about 0.002% and about 0.3% of a graft initiator. Advantageously, the above-described formulation further comprises between about 0.02% and about 2% of a high molecular weight silicone; between about 0.002% and about 0.15% of a urethane acrylate prepolymer; between about 0.002% and about 0.15% of a polyethylene glycol diacrylate; and between about 0.004% and about 2% of a polyethylene glycol.

The composition is stable with less than 5% of the prepolymers self-polymerizing at a temperature of between about 60° F. and 90° F. during storage over a period of at least 2 months. The solids content of the stable composition upon drying is at least about 5% by weight.

This formulation in the second step is contacted to the cotton fibers to pick-up between about 40 grams and about 120 grams of the stable composition to about 100 grams of cotton fibers. The method of contacting and of controlling the wet pick-up can be any method known to the art. The cotton fibers are in the third step dried by exposure to a temperature sufficient for at least 20%, preferably at least 50%, more preferably at least 80%, of the prepolymers and silicone oil to polymerize into polymers grafted onto the cotton fiber. It is recognized that some prepolymers may self-polymerize during the drying step, and these polymers beneficially may be loosely bound to the fiber. This is one form of the prior art—it is known to crosslink treatment chemicals to themselves. This treatment loses effectiveness as the treatment chemicals are removed. A substantial fraction of the treatment chemicals of the present invention are grafted to the fiber, however, and therefore is not prone to be removed by abrasion and laundering.

One advantage of this process is that coating with treatment chemicals followed by drying, typically at a temperature of 300° F. to 400° F., is routinely performed, for example on a tenter frame during stretching.

In one embodiment, the treatment compositions is a stable single-contact formulation, wherein the activators and catalysts co-exist in the stable formulation with the prepolymers. The formulation can be stored and used at normal ambient temperature without congealing or polymerizing.

In a more preferred embodiment, the cotton fibers are coated with a stable composition comprising: between about 0.8% and about 3.5% of a glyoxal prepolymer; between about 0.2% and about 2% of an elastomeric latex prepolymer; between about 8% and about 30% of an aqueous silicone oil emulsion; between about 0.8% and about 4% of a urethane prepolymer emulsion; between about 0.006% and about 0.2% of a catalyst; and between about 0.006% and about 0.2% of a graft initiator. The stable composition advantageously further comprises between about 0.1% and about 1.5% of a high molecular weight silicone; between about 0.004% and about 0.08% of a urethane acrylate prepolymer; between about 0.004% and about 0.08% of a polyethylene glycol diacrylate; and between about 0.1% and about 1% of a polyethylene glycol.

The concentration and the wet pick-up are to some extent trade-offs, but certain advantages are inherent in the more concentrated formulations, including less solvent to evaporate. In one embodiment the contacting picks-up between about 60 grams and about 100 grams of the stable composition to about 100 grams of cotton fibers.

The drying temperature is between about 110° F. and 440° F., preferably between about 250° F. and 400° F., say about 340° F., and the drying time is between about 10 seconds and 10 minutes, say about 1 minute. Without being bound by theory, it is believed that both the water loss from the drying and also the elevated temperature contribute to effective grafting and polymerizing.

One preferred treatment formulation comprises: between about 1% and about 3% of a glyoxal prepolymer; between about 0.4% and about 1.5% of an elastomeric latex prepolymer; between about 10% and about 30% of an aqueous silicone oil emulsion; between about 1% and about 3.5% of a urethane prepolymer emulsion; between about 0.2 and about 1% of a high molecular weight silicone; between about 0.01% to about 0.05% of a urethane acrylate prepolymer; between about 0.01% to about 0.05% of a polyethylene glycol diacrylate; between about 0.01% and about 0.05% of a catalyst; between about 0.01% and about 0.05% of a graft initiator; and between about 0.16% to about 0.8% of a polyethylene glycol. Treatment of cotton, particularly of dyed cotton, with this formulation results in fabric that has good hand, a crock factor of about 4 to 4.5 on the standard scale of 1 (bad) to 5 (excellent). Fabric so treated also has has excellent colorfastness and low shrinkage, for example near about 3.55 to 4%, where untreated cotton may exhibit shrinkage of around 8%.

In one embodiment the stable treating composition is provided by admixing a stable concentrated composition with water or other solvent. This concentrate includes between about 2% and about 10% of a glyoxal prepolymer; between about 0.5% and about 6% of an elastomeric latex prepolymer; between about 30% and about 70% of an aqueous silicone oil emulsion; between about 1% and about 10% of a urethane prepolymer emulsion; between about 0.01% to about 0.6% of a catalyst; and between about 0.01% to about 0.6% of a graft initiator. A preferred formulation further includes: between about 0.1% and about 4% of a high molecular weight silicone; between about 0.01% and about 0.3% of a urethane acrylate prepolymer; between about 0.2% and about 4% of a polyethylene glycol; and between about 0.01% and about 0.3% of a polyethylene glycol diacrylate. The concentrated composition is diluted, for example with water added at a weight ratio of from about 2 parts concentrate: 100 parts water to about 100 parts concentrate: 100 parts water, preferably from about 4 parts concentrate: 100 parts water to about 50 parts concentrate: 100 parts water, more preferably from about 10 parts concentrate: 100 parts water to about 25 parts concentrate: 100 parts water. In one preferred embodiment, the treating composition is formed by adding one part concentrate to between 2 and 4 parts water or other solvent. Again, the concentrated solution is advantageously stable over normal storage conditions, for example the concentrated composition is a fluid with less than 5% of the prepolymers self-polymerizing at a temperature of between about 60° F. and 90° F. during storage over a period of at least 2 months. The stable concentrated composition typically comprises between about 10% and about 35% solids when dried.

In one embodiment the stable concentrated composition comprises: between about 4% and about 7%, for example about 5.6%, of a glyoxal prepolymer; between about 1% and about 4%, for example about 2.8%, of an elastomeric latex prepolymer; between about 40% and about 60%, for example about 56.1%, of an aqueous silicone oil emulsion; between about 4% and about 8%, for example about 5.6%, of a urethane prepolymer emulsion; between about 0.03% and about 0.2%, for example about 0.06%, of a catalyst; and between about 0.03% and about 0.2%, for example about 0.06%, of a graft initiator. The formulation advantageously includes between about 0.5% and about 3%, for example about 1.63%, of a high molecular weight silicone; between about 0.02% and about 0.15%, for example about 5.6%, of a urethane acrylate prepolymer; between about 0.5% to about 2%, for example about 1%, of a polyethylene glycol (preferably diethylene glycol); and between about 0.02% and about 0.15%, for example about 0.06%, of a polyethylene glycol diacrylate. This stable concentrated composition comprises between about 20% and about 32% solids when dried.

In yet one embodiment the stable concentrated composition comprises: between about 4% and about 7% of a glyoxal prepolymer; between about 1% and about 4% of an elastomeric latex prepolymer; between about 40% and about 60% of an aqueous silicone oil emulsion; between about 4% and about 8% of a urethane prepolymer emulsion; between about 0.5% and about 3% of a high molecular weight silicone; between about 0.02% and about 0.15% of a urethane acrylate prepolymer; between about 0.5% to about 2% of a polyethylene glycol (preferably diethylene glycol); and between about 0.02% and about 0.15% of a polyethylene glycol diacrylate. In this embodiment the catalyst and graft initiator are added separately, or, alternatively, ozone and/or irradiation and/or another method of initiating and propagating grafted polymers is used.

In another embodiment the stable concentrated composition comprises: between about 5% and about 6% of a glyoxal prepolymer; between about 2% and about 3% of an elastomeric latex prepolymer; between about 52% and about 60% of an aqueous silicone oil emulsion; between about 5% and about 7% of a urethane prepolymer emulsion; between about 0.03% to about 0.1% of a catalyst; between about 0.03% to about 0.1% of a graft initiator; between about 1% and about 2% of a high molecular weight silicone; between about 0.04% to about 0.1% of a urethane acrylate prepolymer; between about 0.04% to about 0.1% of a polyethylene glycol diacrylate; and between about 0.6% to about 1.6% of a polyethylene glycol. This stable concentrated composition comprises between about 25% and about 30% solids when dried.

The graft initiator may comprise salts of Fe, Ag, Co, Cu, or mixtures thereof. These metal salts are advantageously used with a catalyst to rejuvenate the graft initiator. The catalyst comprises a strong oxidizer, for example a peroxide, peracid, perbenzoate, or mixtures thereof. The glyoxal prepolymer is a low-formaldehyde prepolymer such that the polymer forms less than 30 ppm formaldehyde in treated fiber.

If the cotton fiber comprises undyed cotton, the stable treatment compositions described above advantageously further includes between about 0.4% and about 8%, preferably between about 0.8% and about 6%, more preferably between about 1.2% and about 4.5%, of a fluoroalkyl acrylate. The concentrated stable compositions described above advantageously further include between about 2% and about 16%, preferably between about 4% and about 12%, more preferably between about 6% and about 9%, of a fluoroalkyl acrylate.

The treatment compositions are added to the fibers, for example to the fabric, by any method and the polymers are then caused to graft to the fibers and also to crosslink, typically but not exclusively by the application of heat, for example about 340° F. for a period of about 30 seconds to about 5 minutes. The application may be effected, for instance, by padding, saturating, spraying, or the like. For example, cellulosic fabric may be immersed in a bath of treating solution. The treatment compositions may be emulsified nonionic or ionic materials.

Thicker fabric may require longer heating at higher temperatures. Thicker fabrics may preferably be oven cured at about 320° F. to 375° F. for about 1 to 15 minutes.

The invention includes both the treatment compositions and the method of treatment.

The invention also includes the product of the process of treating cotton fibers and/or fabrics with the above-described treatment compositions. Fabric made of treated cotton advantageously has a shrinkage of less than about 4.5%, preferably less than about 4%, a crockfastness of at least 4 on the below-described standard test, and a good hand.

Dyed Cotton/Polyester and Un-dyed Cotton/Polyester

While the compositions described in DYED COTTON AND UN-DYED COTTON work well for cotton/polyester blends, different formulations provide even superior properties for cotton/polyester blends.

One embodiment of the invention relates to a method of treating cotton/polyester fibers that includes providing a stable fluid composition comprising, between about 1.6% and about 18% of acrylic prepolymer, between about 0.1% and about 3% of an elastomeric latex prepolymer, between about 6% and about 35% of an organopolysiloxane emulsion, between about 0.1% and about 3% of a urethane prepolymer emulsion, between about 0.002% and about 0.3% of a catalyst, and between about 0.002% and about 0.3% of a graft initiator. Beneficially, the treatment fluid also contains between about 0.002% and about 0.2% of a polyethylene glycol diacrylate. In another embodiment the composition also includes between about 0.002% and about 0.2% of a surfactant monomer. Again, it is important that the treatment composition be stable for at least 2 months at ambient storage conditions. Again, stable means less than 5% of the prepolymers self-polymerize at a temperature of between about 60° F. and 90° F. during storage over a period of at least 2 months, and wherein the solids content of the stable composition upon drying is at least about 5% by weight.

This treatment fluid is contacted with the cotton/polyester fibers to pick-up between about 40 grams and about 120 grams, for example between about 60 grams and about 100 grams, of the stable composition to about 100 grams of cotton/polyester fibers. The quantity of fluid remaining after contacting the fluid, and any fluid removal, is known as the percent wet pickup.

Then, the polymerizable components of the treatment fluid are made to form grafts onto the cotton/polyester fibers. In one embodiment this polymerization is achieved by drying the cotton fibers by exposure to a temperature sufficient for at least half of the prepolymers and organopolysiloxane to polymerize into polymers grafted onto the cotton fiber. The drying temperature in one embodiment is between about 250° F. and 400° F. and the drying time is between about 10 seconds and 10 minutes.

The stable composition in another embodiment includes: between about 3.2% and about 15% of acrylic prepolymer; between about 0.2% and about 2% of an elastomeric latex prepolymer; between about 8% and about 30% of an organopolysiloxane emulsion; between about 0.2% and about 2% of a urethane prepolymer emulsion; between about 0.004% and about 0.1% of a catalyst; and between about 0.004% and about 0.1% of a graft initiator. The stable composition beneficially further comprises between about 0.004% and about 0.1% of a polyethylene glycol diacrylate; and between about 0.002% and about 0.2% of a surfactant monomer.

In one preferred embodiment for treating cotton/polyester fibers, the stable composition comprises: between about 4% and about 12% of acrylic prepolymer; between about 0.4% and about 1.5% of an elastomeric latex prepolymer; between about 9% and about 26% of an organopolysiloxane emulsion; between about 0.4% and about 1.5% of a urethane prepolymer emulsion; between about 0.006% and about 0.05% of a catalyst; between about 0.006% and about 0.05% of a graft initiator; between about 0.006% and about 0.05% of a polyethylene glycol diacrylate; and between about 0.006% and about 0.05% of a surfactant monomer.

The treatment composition is beneficially provided by a one-composition fluid concentrate. Such a fluid concentrate may contain between about 8% and about 35% of acrylic prepolymer; between about 0.5% and about 6% of an elastomeric latex prepolymer; between about 30% and about 70% of an organopolysiloxane emulsion; between about 0.5% and about 6% of a urethane prepolymer emulsion; between about 0.01% and about 0.4% of a catalyst; between about 0.01% and about 0.4% of a graft initiator. The treatment provides a superior product if it also contains between about 0.01% and about 0.4% of a polyethylene glycol diacrylate and between about 0.01% and about 0.4% of a surfactant monomer. Again, the concentrated composition is stable with less than 5% of the prepolymers self-polymerizing at a temperature of between about 60° F. and 90° F. during storage over a period of at least 2 months, and wherein the stable concentrated composition comprises between about 10% and about 35% solids when dried.

The fluid concentrate is diluted using the same dilution factors as described above, that is, water can be added at a weight ratio of from about 2 parts concentrate: 100 parts water to about 100 parts concentrate: 100 parts water, preferably from about 4 parts concentrate: 100 parts water to about 50 parts concentrate: 100 parts water, more preferably from about 10 parts concentrate: 100 parts water to about 25 parts concentrate: 100 parts water. In one preferred embodiment, the treating composition is formed by adding one part concentrate to between 2 and 4 parts water or other solvent.

The stable concentrated composition in one embodiment includes: between about 16% and about 30% of acrylic prepolymer; between about 1% and about 4% of an elastomeric latex prepolymer; between about 38% and about 60% of an organopolysiloxane emulsion; between about 1% and about 4% of a urethane prepolymer emulsion; between about 0.02% and about 0.2% of a catalyst; between about 0.02% and about 0.2% of a graft initiator. The concentrate may also contain between about 0.02% and about 0.2% of a polyethylene glycol diacrylate and between about 0.02% and about 0.2% of a surfactant monomer.

In another embodiment the stable concentrated composition includes between about 20% and about 24% of acrylic prepolymer; between about 2% and about 3% of an elastomeric latex prepolymer; between about 46% and about 52% of an organopolysiloxane emulsion; between about 2% and about 3% of a urethane prepolymer emulsion; between about 0.03% and about 0.1% of a catalyst; between about 0.03% and about 0.1% of a polyethylene glycol diacrylate; between about 0.03% and about 0.1% of a surfactant monomer; and between about 0.03% and about 0.1% of a graft initiator.

This concentrate beneficially has between about 25% and about 32% solids, preferably between about 25% and about 30% solids, when dried.

The surfactant monomer can be any surfactant monomer, also called an ionic monomers. Such a monomer may contain sulfonate groups, such as sodium vinyl sulfonate, sodium p-styrenesulfonate, sodium methallyl sulfonate, sodium p-sulfophenyl methallyl ether, or sodium 2-methyl-2-acrylamidopropane sulfonate. Such groups are known to increase hydrophilicity. Carboxylate-containing comonomers such as itaconic acid are also surfactant monomers. The preferred surfactant monomer is surfactant monomer is sodium vinyl sulfonate.

The graft initiator may be one or more salts of Fe, Ag, Co, Cu, or mixtures thereof, as described before. Similarly, the catalyst may be a peroxide, peracid, perbenzoate, or mixtures thereof.

If the cotton/polyester fiber comprises undyed cotton/polyester fiber, the stable composition beneficially further includes between about 0.4% and about 8% of a fluoroalkyl acrylate, for example between about 0.8% and about 6% of a fluoroalkyl acrylate, preferably between about 1.2% and about 4.5% of a fluoroalkyl acrylate.

The concentrated stable composition that provides a preferred treated undyed cotton/polyester fiber further comprises between about 2% and about 16% of a fluoroalkyl acrylate, for example between about 4% and about 12% of a fluoroalkyl acrylate, preferably between about 6% and about 9% of a fluoroalkyl acrylate.

Again, the invention also relates to the treated product, as well as to articles, fabric, yarn, and staple that include treated fibers.

The invention also relates to both the stable treatment fluid and to the stable concentrated composition for treating cotton/polyester fibers.

Printed Cotton

A method of treating cotton fibers that have been previously printed with dye includes providing a stable fluid composition comprising: between about 1% and about 12% of acrylic prepolymer; between about 0.08% and about 2% of an elastomeric latex prepolymer; between about 3% and about 25% of an organopolysiloxane emulsion; between about 0.08% and about 2% of a urethane prepolymer emulsion; between about 1.4% and about 11.5% of a high density polyethylene prepolymer; between about 0.8% and about 9% of a polyamide prepolymer between about 0.0004% and about 0.15% of a catalyst; and between about 0.0004% and about 0.15% of a graft initiator. Beneficially, between about 0.08% and about 2% of a non-ionic dispersant; between about 0.0004% and about 0.15% of a polyethylene glycol diacrylate; and between about 0.0004% and about 0.15% of a urethane acrylate are also included. Again, the treatment composition is stable with less than 5% of the prepolymers self-polymerizing at a temperature of between about 60° F. and 90° F. during storage over a period of at least 2 months.

The solids content of the stable composition upon drying is at least about 5% by weight.

This treatment fluid is contacted with the printed cotton fibers to pick-up between about 40 grams and about 120 grams of the stable composition to about 100 grams of cotton fibers, beneficially between about 60 grams and about 100 grams of the stable composition to about 100 grams of printed cotton fibers.

Finally, the method includes causing the grafted polymers to form. In one embodiment this occurs as a result of drying the cotton fibers by exposure to a temperature sufficient for at least half of the prepolymers and silicone oil to polymerize into polymers grafted onto the printed cotton fiber. For example, the drying temperature may be between about 250° F. and 400° F. and the drying time is between about 10 seconds and 10 minutes.

In one embodiment the stable composition comprises: between about 1.6% and about 10% of acrylic prepolymer; between about 0.2% and about 1.5% of an elastomeric latex prepolymer; between about 5% and about 23% of an organopolysiloxane emulsion; between about 0.2% and about 1.5% of a urethane prepolymer emulsion; between about 2% and about 10% of a high density polyethylene prepolymer; between about 1.4% and about 7.5% of a polyamide prepolymer between about 0.002% and about 0.1% of a catalyst; and between about 0.002% and about 0.1% of a graft initiator. Again, the presence of between about 0.2% and about 1.5% of a non-ionic dispersant; between about 0.002% and about 0.1% of a polyethylene glycol diacrylate; and between about 0.002% and about 0.1% of a urethane acrylate provides a preferred product. The fluid should, of course, be stable.

In one embodiment the stable composition for treating printed cotton includes between about 2.4% and about 8% of acrylic prepolymer; between about 0.3% and about 1% of an elastomeric latex prepolymer; between about 6% and about 20% of an organopolysiloxane emulsion; between about 0.3% and about 1% of a urethane prepolymer emulsion; between about 2.6% and about 8.5% of a high density polyethylene prepolymer; between about 2% and about 6% of a polyamide prepolymer; between about 0.006% and about 0.05% of a catalyst; between about 0.006% and about 0.05% of a graft initiator; between about 0.3% and about 1% of a non-ionic dispersant; between about 0.006% and about 0.05% of a polyethylene glycol diacrylate; and between about 0.006% and about 0.05% of a urethane acrylate.

In yet another embodiment, the stable composition is provided by admixing a stable concentrated composition comprising between about 5% and about 24% of acrylic prepolymer; between about 0.4% and about 4% of an elastomeric latex prepolymer; between about 15% and about 50% of an organopolysiloxane emulsion; between about 0.4% and about 4% of a urethane prepolymer emulsion; between about 7% and about 23% of a high density polyethylene prepolymer; between about 4% and about 18% of a polyamide prepolymer between about 0.002% and about 0.3% of a catalyst; and between about 0.002% and about 0.3% of a graft initiator with water or other solvent. The concentrated composition may further comprise between about 0.4% and about 4% of a non-ionic dispersant; between about 0.002% and about 0.3% of a polyethylene glycol diacrylate; and between about 0.002% and about 0.3% of a urethane acrylate. The dilution of the stable concentrate is the same as was previously described for other stable concentrates.

The concentrated composition is stable with less than 5% of the prepolymers self-polymerizing at a temperature of between about 60° F. and 90° F. during storage over a period of at least 2 months.

Dilution of the concentrate can be by water can be added at a weight ratio of from about 2 parts concentrate: 100 parts water to about 100 parts concentrate: 100 parts water, preferably from about 4 parts concentrate: 100 parts water to about 50 parts concentrate: 100 parts water, more preferably from about 10 parts concentrate: 100 parts water to about 25 parts concentrate: 100 parts water.

The stable concentrated composition comprises between about 10% and about 35% solids, preferably between about 25% and about 32% solids, when dried.

In one embodiment the stable concentrated composition comprises: between about 8% and about 20% of acrylic prepolymer; between about 1% and about 3% of an elastomeric latex prepolymer; between about 25% and about 46% of an organopolysiloxane emulsion; between about 1% and about 3% of a urethane prepolymer emulsion; between about 10% and about 20% of a high density polyethylene prepolymer; between about 7% and about 15% of a polyamide prepolymer; between about 0.01% and about 0.2% of a catalyst; and between about 0.01% and about 0.2% of a graft initiator. The concentrate is further improved by including between about 1% and about 3% of a non-ionic dispersant; between about 0.01% and about 0.2% of a polyethylene glycol diacrylate; and between about 0.01% and about 0.2% of a urethane acrylate.

In yet another preferred embodiment, the stable concentrated composition comprises: between about 12% and about 16% of acrylic prepolymer; between about 1.5% and about 2% of an elastomeric latex prepolymer; between about 30% and about 40% of an organopolysiloxane emulsion; between about 1.5% and about 2% of a urethane prepolymer emulsion; between about 13% and about 17% of a high density polyethylene prepolymer; between about 10% and about 12% of a polyamide prepolymer; between about 0.03% and about 0.1% of a catalyst; between about 0.03% and about 0.1% of a graft initiator; between about 1.5% and about 2% of a non-ionic dispersant; between about 0.03% and about 0.1% of a polyethylene glycol diacrylate; and between about 0.03% and about 0.1% of a urethane acrylate. This stable concentrated composition comprises between about 25% and about 30% solids when dried.

Again, the graft initiator advantageously comprises a salt or salts of Fe, Ag, Co, Cu, or mixtures thereof. The initiator may include a magnesium salt. The catalyst comprises a strong oxidizer, for example a peroxide, peracid, perbenzoate, or mixtures thereof. Urea peroxide is most preferred.

Again, the invention also relates to the treated product, as well as to articles, fabric, yarn, and staple that include treated fibers.

The invention also relates to both the stable treatment fluid and to the stable concentrated composition for treating cotton/polyester fibers.

Printed Cotton/Polyester

A treatment composition especially suited for cotton/polyester fibers that have been previously printed with dye is described herein. The printed cotton/polyester fibers are contacted with a stable fluid composition comprising: between about 1% and about 20% of acrylic prepolymer; between about 0.08% and about 2% of an elastomeric latex prepolymer; between about 6% and about 35% of an organopolysiloxane emulsion; between about 0.08% and about 2% of a polyamide prepolymer; between about 0.2% and about 4% of an adhesive gum, for example a carboxylated butadiene acrylonitrile prepolymer; between about 0.001% and about 0.15% of a catalyst; between about 0.001% and about 0.15% of a graft initiator; and advantageously between about 0.001% and about 0.15% of a polyethylene glycol diacrylate and between about 0.001% and about 0.15% of a surfactant monomer. The composition is stable with less than 5% of the prepolymers self-polymerizing at a temperature of between about 60° F. and 90° F. during storage over a period of at least 2 months. The solids content of the stable composition upon drying is at least about 5% by weight.

The contacting can be by any method, and preferably the printed cotton/polyester fibers pick-up between about 40 grams and about 120 grams of the stable composition to about 100 grams of cotton fibers, preferably between about 60 grams and about 100 grams of the stable composition to about 100 grams of printed cotton/polyester fibers.

Finally, the polymerizable material in the treatment composition is polymerized onto the printed cotton/polyester fibers to form grafted polymers. This forming a grafted polymers may be initiated by drying the printed cotton/polyester fibers at a temperature sufficient for at least half of the prepolymers and organospolysiloxane to polymerize into polymers grafted onto the printed cotton fiber. The drying temperature can be between about 250° F. and 400° F. and the drying time can be between about 10 seconds and 10 minutes.

In one embodiment the stable composition includes: between about 2% and about 15% of acrylic prepolymer; between about 0.2% and about 1.5% of an elastomeric latex prepolymer; between about 8% and about 30% of an organopolysiloxane emulsion; between about 0.2% and about 1.5% of a polyamide prepolymer; between about 0.4% and about 3% of a carboxylated butadiene acrylonitrile prepolymer; between about 0.002% and about 0.05% of a catalyst; between about 0.002% and about 0.05% of a graft initiator; and advantageously between about 0.002% and about 0.05% of a polyethylene glycol diacrylate and between about 0.002% and about 0.05% of a surfactant monomer.

The stable composition in one embodiment includes between about 3.6% and about 12% of acrylic prepolymer; between about 0.3% and about 1.25% of an elastomeric latex prepolymer; between about 9% and about 27% of an organopolysiloxane emulsion; between about 0.3% and about 1.25% of a polyamide prepolymer; between about 0.6% and about 2.5% of a carboxylated butadiene acrylonitrile prepolymer; between about 0.004% and about 0.03% of a catalyst; between about 0.004% and about 0.03% of a graft initiator between about 0.004% and about 0.03% of a polyethylene glycol diacrylate; and between about 0.004% and about 0.03% of a surfactant monomer.

In yet another embodiment the stable composition is provided by admixing between a stable concentrated composition comprising: between about 5% and about 40% of acrylic prepolymer; between about 0.4% and about 4% of an elastomeric latex prepolymer; between about 30% and about 70% of an organopolysiloxane emulsion; between about 0.4% and about 4% of a polyamide prepolymer; between about 1% and about 8% of a carboxylated butadiene acrylonitrile prepolymer; between about 0.005% and about 0.3% of a catalyst; and between about 0.005% and about 0.3% of a graft initiator with a solvent, for example water. Advantageously, the concentrate also includes between about 0.005% and about 0.3% of a polyethylene glycol diacrylate and between about 0.005% and about 0.3% of a surfactant monomer.

The concentrated composition is stable with less than 5% of the prepolymers self-polymerizing at a temperature of between about 60° F. and 90° F. during storage over a period of at least 2 months.

The stable concentrated composition comprises between about 10% and about 35% solids when dried, preferably between about 25% and about 32% solids, more preferably between about 25% and about 30% solids. when dried.

In one embodiment the stable concentrated composition includes between about 10% and about 30% of acrylic prepolymer; between about 1% and about 30% of an elastomeric latex prepolymer; between about 40% and about 60% of an organopolysiloxane emulsion: between about 1% and about 3% of a polyamide prepolymer, between about 2% and about 6% of a carboxylated butadiene acrylonitrile prepolymer; between about 0.01% and about 0.1% of a catalyst; and between about 0.01% and about 0.1% of a graft initiator. The stable concentrated composition advantageously also includes between about 0.01% and about 0.1% of a polyethylene glycol diacrylate and between about 0.01% and about 0.1% of a surfactant monomer.

In a preferred embodiment the stable concentrated composition includes between about 18% and about 24% of acrylic prepolymer; between about 1.5% and about 2.5% of an elastomeric latex prepolymer; between about 46% and about 54% of an organopolysiloxane emulsion, between about 1.5% and about 2.5% and about 2.5% of a polyamide prepolymer; between about 3% and about 5% of a carboxylated butadiene acrylonitrile prepolymer; between about 0.02% and about 0.06% of a catalyst; between about 0.02% and about 0.06% of a graft initiator; between about 0.02% and about 0.06% of a polyethylene glycol diacrylate; and between about 0.02% and about 0.06% of a surfactant monomer.

The method treating the printed cotton/polyester fibers can be performed when the fibers are in the form of textile.

In one embodiment the graft initiator comprises a salt or salts of Fe, Ag, Co, Cu, or mixtures thereof. In another embodiment the initiator comprises a salt of Fe, Mg, or a mixture thereof. The catalyst comprises a peroxide, peracid, perbenzoate, or mixtures thereof.

Again, the invention also relates to the treated product, as well as to articles, fabric, yarn, and staple that include treated fibers.

The invention also relates to both the stable treatment fluid and to the stable concentrated composition for treating printed cotton/polyester fibers.

Cotton Stretch Component

It is sometimes necessary to use cotton fibers in a stretch composition. It has been surprisingly found that cotton fiber with a heavy loading of a particular prepolymer graft combination exhibits not only excellent stain resistance, good hand, and excellent crockfastness, but also exhibits excellent recoverability after stretching. A commercial mixture used for this purpose is a mechanical blend of cotton (about 95%) and SPANDEX (TM) or LYCRA (TM). While the previously described formulations work well for treating cotton fibers intended for this use, a special stable fluid formulation useful for imparting stretchability and recoverability to cotton fibers includes between about 0.8% and about 15% of acrylic prepolymer; between about 0.4% and about 9% of a high molecular weight silicone; between about 6% and about 35% of a silicone oil emulsion; between about 1.5% and about 12% of a urethane; between about 0.0004% and about 0.15% of a catalyst; and between about 0.0004% and about 0.15% of a graft initiator. Advantageously, the treatment composition also includes between about 0.0004% and about 0.15% of a polyethylene glycol diacrylate and between about 0.0004% and about 0.15% of a urethane acrylate prepolymer.

Unlike other composition treatments, which advantageously have a loading after grafting and polymerizing of between about 2 and about 6%, the loading of the cotton is advantageously between about 3% and about 10%, for example between about 5% and about 7%. Such a loading will allow fabric that has been stretched to about 150% of its original length, held for thirty seconds, and, after allowing the fabric to relax thirty more seconds, the fabric will recover to about 95% to about 115%, preferably between about 97% to about 108%, of its original size. This can be repeated, with substantially the same results, at least 5 and preferably at least 10 times on a treated fabric.

Advantageously the composition is stable with less than 5% of the prepolymers self-polymerizing at a temperature of between about 60° F. and 90° F. during storage over a period of at least 2 months.

The stretchable cotton fibers are contacted with this treatment composition to pick-up between about 40 grams and about 200 grams of the stable composition to about 100 grams of cotton fibers, beneficially between about 60 grams and about 140 grams. Beneficially, the fiber is dry before contacting the treatment composition to enhance fluid migration into the fiber structure.

The prepolymers within the treatment fluid are then made to graft and to polymerize onto the stretchable cotton fibers, for example by exposure to a temperature sufficient for at least half of the prepolymers and silicone oil to polymerize into polymers grafted onto the stretchable cotton fibers. A drying temperature of between about 250° F. and 400° F. for a drying time of between about 10 seconds and 10 minutes is sufficient for most fabrics.

In one embodiment the stable composition includes between about 2% and about 10% of acrylic prepolymer; between about 0.8% and about 7% of a high molecular weight silicone; between about 8% and about 30% of a silicone oil emulsion; between about 1.2% and about 8% of a urethane; between about 0.002% and about 0.1% of a catalyst; between about 0.002% and about 0.1% of a graft initiator; and advantageously between about 0.002% and about 0.1% of a polyethylene glycol diacrylate and between about 0.002% and about 0.1% of a urethane acrylate prepolymer.

The stable composition in one preferred embodiment includes between about 2.4% and about 8% of acrylic prepolymer; between about 1.2% and about 5% of a high molecular weight silicone; between about 10% and about 27% of a silicone oil emulsion; between about 1.6% and about 6% of a urethane; between about 0.006% and about 0.05% of a catalyst; between about 0.006% and about 0.05% of a graft initiator; between about 0.006% and about 0.05% of a polyethylene glycol diacrylate; and between about 0.006% and about 0.05% of a urethane acrylate prepolymer.

The stable composition may be provided by admixing a stable concentrated fluid composition including between about 4% and about 30% of acrylic prepolymer; between about 2% and about 18% of a high molecular weight silicone; between about 30% and about 70% of a silicone oil emulsion; between about 3% and about 24% of a urethane; between about 0.002% and about 0.3% of a catalyst; between about 0.002% and about 0.3% of a graft initiator, and advantageously between about 0.002% and about 0.3% of a polyethylene glycol diacrylate and between about 0.002% and about 0.3% of a urethane acrylate prepolymer.

Again, this concentrated composition is stable with less than 5% of the prepolymers self-polymerizing at a temperature of between about 60° F. and 90° F. during storage over a period of at least 2 months.

The stable concentrated composition comprises between about 10% and about 35% solids when dried, preferably between about 25% and about 32% solids when dried.

In one embodiment the stable concentrated composition includes between about 10% and about 20% of acrylic prepolymer; between about 4% and about 14% of a high molecular weight silicone; between about 40% and about 60% of a silicone oil emulsion; between about 6% and about 16% of a urethane; between about 0.01% and about 0.2% of a catalyst; between about 0.01% and about 0.2% of a graft initiator; and advantageously between about 0.01% and about 0.2% of a polyethylene glycol diacrylate; and between about 0.01% and about 0.2% of a urethane acrylate prepolymer.

In one preferred embodiment the stable concentrated composition includes between about 12% and about 16% of acrylic prepolymer; between about 6% and about 10% of a high molecular weight silicone; between about 50% and about 55% of a silicone oil emulsion; between about 8% and about 12% of a urethane; between about 0.03% and about 0.1% of a catalyst; between about 0.03% and about 0.1% of a graft initiator; between about 0.03% and about 0.1% of a polyethylene glycol diacrylate; and between about 0.03% and about 0.1% of a urethane acrylate prepolymer. This stable concentrated composition contains between about 25% and about 30% solids when dried.

The stretchable cotton fibers are beneficially in the form of textile.

The graft initiator in one embodiment comprises a salt or salts of Fe, Ag, Co, Cu, or mixtures thereof. In another embodiment the initiator comprises a salt or salts of Fe, Mg, or a mixture thereof.

The catalyst in one embodiment is a peroxide, peracid, perbenzoate, periodate, or mixtures thereof.

The printing of non-reactive pigments onto cotton and cotton/polyester is known. One adhesive includes a carboxylated butadiene acrylonitrile, though many other adhesive gums are know. We have surprisingly found that by incorporating a small amount of crosslinkers, in particular between about 0.01% and 0.3%, preferably between about 0.02% and about 0.1%, more preferably between about 0.03 and 0.06, of at least one crosslinking prepolymer, crockfastness and colorfastness is improved. A preferred composition has both a urethane acrylate and a polyethylene glycol diacrylate present at the above concentration ranges in carboxylated butadiene acrylonitrile. It may be necessary to incorporate a small amount of water, for example about 0.1 to about 1%, to stabilize this polymer composition.

Compatible adjuvants can be added to the compositions herein for their known purposes. Such adjuvants include, but are not limited to, viscosity control agents, perfumes, emulsifiers, preservatives, UV light absorbers, antioxidants, bactericides, fungicides, colorants, dyes, fluorescent dyes, brighteners, opacifiers, soil release agents, and shrinkage control agents. An example of a useful class of antimicrobial agents that will impart antimicrobial activity to the fiber includes polymerizable protonated amines. An example of a useful class of flame retardant includes polymerizable vinylidene chloride. In addition, an antioxidant, antiozonant or other stabilizer can be added to the fabric to increase its resistance to aging, high temperature induced degradation or discoloration. It is beneficial to bind the adjuvants to the treated fiber to prolong the useful life of the adjuvants. The adjuvants can in certain conditions be copolymerized with the treatment composition, or may be exchanged onto receptive monomers incorporated into the treatment. These adjuvants, if used, are added at their usual levels, excepting the flame retardant generally each of up to about 5% by weight of the preferred liquid composition.

In one embodiment, the adjuvant includes a polymerizable hydrophobic monomer or prepolymer in a quantity sufficient to substantially increase the hydrophobicity of the treated fiber. In some instances an adjuvant can have more than one function, for example a di-alkyl fatty acid amine can impart both antimicrobial properties as well as change the hydrophobic character of the fiber. In another embodiment, hydrophillic monomers or prepolymers are incorporated in a quantity sufficient to substantially increase the hydrophillic character of the treated fiber. Examples include the aforementioned surfactant monomers, i.e., sodium p-styrenesulfonate, sodium methallyl sulfonate, sodium p-sulfophenyl methallyl ether, sodium 2-methyl-2-acrylamidopropane sulfonate, as well as carboxylate-containing monomers such as itaconic acid. It may be beneficial to treat certain areas or sides of the fiber or fabric with certain adjuvants and to treat other areas or sides with other adjuvants. For example, a bandage advantageously includes antimicrobial properties as well as hydrophobic and hydrophillic areas or sides of an area.

The formulations described for each of the cotton and cotton/polyester fibers above are beneficial because they can be applied with no new equipment or processing steps. The method of the present invention contemplates contacting fibers and yarns and fabrics with a grafting solution at any stage of yarn or fabric production. Thus, the grafting solution may be applied to staple or filament fibers, yarns or formed fabric. The treatment composition may be grafted onto filaments during a spin finishing operation and thereafter formed into the fabric. In addition, yarns may be formed from the grafted filaments, and thereafter, the yarns are formed into the fabric. Alternatively, the yarns may be formed from non-grafted filaments, the treatment composition is then grafted onto the yarns, and thereafter, the yarns are formed into the fabric.

It is also possible to beam the yarns and then graft the treatment composition onto the beamed yarn during a slashing operation, or to beam the grafted yarns prior to forming the fabric. Furthermore, it is possible to repackage the grafted yarns and then utilize the repackaged yarns as wrap or fill yarns during formation of the fabric.

The treatment composition may also be grafted onto staple and the grafted staple is then spun into yarn. The grafted filaments may be cut into staple and the staple then spun into yarns. The filaments or yarns or fabrics may be contacted with a solution of the first component by a dipping, spraying, or coating operation.

It is still further contemplated that the fibers or yarns may be contacted with graft solution either before or after chemical or mechanical production operations such as spin finishing, application of lubricants, or sizing. Furthermore, the graft solution may be applied to the yarns or fibers after formation of a fabric therefrom. The fabric may be contacted with grafting solution either before, during, or after chemical and mechanical finishing operations such as the application of fabric softeners or calendaring operations.

The presence of the treatment polymers on fabrics can be inferred by certain tests as described here. Use the 18 inch by 18 inch fabric sample normally used for shrinkage testing as the sample for testing. Sample should be marked for shrinkage in normal manner, as additional shrinkage data can be obtained during testing for polymer. Place in a corner of the 18 inch by 18 inch sample, about one-half teaspoon each of Heinz(TM) Tomato Ketchup, Hersey's(TM) Chocolate Syrup, and Welch's (TM) Grape Juice. Force the contaminants into the fabric, and wipe off excess using a clean paper towel. Then launder the fabric using a detergent such as Tide Ultra Clean (TM) in warm (105° F.) water on a regular cycle. After washing, dry the sample. The three stains should be completely (or nearly completely) removed. Rate the stains on a "1–5" scale with "5" indicating no color, "4" indicating pale color, "3" indicating some color, "2" indicating lots of color and "1 " indicating large color. The treated fabric will have a rating of greater than 3.5, and preferably greater than 4. Untreated cotton has staining values of 1–2.

The shrinkage of the treated fibers in fabric form will be less than 4.5%, preferably less than 4%, most preferably less than 3.5%. Untreated fabric has shrinkage of 7.5 to 9%.

The weight of the loading on the fiber or fabric depends on the desired final use and cost factors. Applicants have surprisingly found that the properties of good hand, colorfastness, resistance to staining, shrinking, and abrasion, increase with the load of treatment chemicals grafted thereon. Economic concerns limit the amount to generally below about 10% by weight. Excellent fabric characteristics are observed with a loading of between about 2% to about 7%, preferably between about 3% and about 5%. The amount of loading of treatment should be at least half of the initial treatment after about 15 washings.

The formulations are prepared by adding a precalculated quantity of a desired prepolymer in a container and to it add monomers, prepolymers, catalyst, graft initiator and other ingredients of the composition. Each ingredient was taken in a concentration ratio by weight as indicated in the compositions described herein. The contents were stirred to a uniform solution.

EXAMPLES

Fabrics were manufactured and treated with formulations described below. The fabric was then tested. Softness ("hand") is the an independent tester's reasonable judgment when compared to a 100% cotton fabric. Crocking was tested using the AATCC Test Method B with a crock meter, both wet and dry. Grading was based on a "1–5" scale with "5" indicating no color transfer, "4" indicating pale color transfer, "3" indicating some color transfer, "2" indicating lots of color transfer and "1" indicating large color transfer. Color fastness was tested using the AATCC Test Method 61 11A. Shrinkage was tested using the AATCC Test Method 135-1992-IVA 111. Abrasion resistance was tested using the Test Method ASTMD1376 (30 minutes).

Example 1

A formulation was prepared that had the composition shown in Table 1. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, a crockfastness of at least 4, no pilling during abrasive resistance testing, and a stain resistance of at least 3.5. The composition was also found to be a stable fluid with no visible precipitation after storage at room temperature for a period of 3 months or more.

TABLE 1

Formulation for Dyed Cotton Fabric

| | Parts By Weight |
|---|---|
| Glyoxal resin prepolymer, Ecco Res GB 404 (TM) | 5.6 |
| Urethane prepolymer, Resamin UMT171 (TM) | 5.6 |
| High mol. wt. Silicone softener, Helastic WO-8026 (TM) | 1.63 |
| Silicone softener, Sequasoft 69 (TM) | 56.13 |
| Elastomeric Latex, Hystretch V-43 (TM) | 2.80 |
| Deionized water | 27.0 |
| Diethylene glycol | 1.0 |
| Urethane acrylate, SR-9035 (TM) | 0.06 |
| Polyethylene glycol diacrylate, SR 344 (TM) | 0.06 |
| Urea peroxide (0.1% in DIW) | 0.06 |
| Ferrous ammonium sulfate solution (0.1 N) | 0.06 |

In another composition, the diethylene glycol was replaced with additional water with little degradation of finished fabric properties.

In another composition, the glyoxal resin prepolymer Ecco Res GB 404 (TM) was replaced with glyoxal resin prepolymer Resin KLF (TM) and the formaldehyde in the fabric was reduced below 30 ppm.

Example 2

A formulation was prepared that had the composition shown in Table 2. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, a crockfastness of at least 4, no pilling during abrasive resistance testing, and a stain resistance of at least 3.5.

TABLE 2

Formulation For Dyed Cotton/Polyester Fabric

| | Parts By Weight |
|---|---|
| Acrylic prepolymer, Helastic 8001 (TM) | 4.86 |
| Urethane prepolymer, Resamine UMT 171 (TM) | 2.43 |
| Acrylic prepolymer, EccoRez 907 (TM) | 2.43 |
| Softener polysiloxane, APS V-soft (TM) | 48.7 |
| Acrylic prepolymer, Helastic WD 8061 (TM) | 14.61 |
| Elastomer Latex, Histretch V-43 (TM) | 2.43 |
| Deionized water | 24.3 |
| Polyethylene glycol diacrylate, SR344 (TM) | 0.05 |
| Sodium vinyl sulfonate | 0.05 |
| Urea peroxide 0.1 N solution | 0.05 |
| Ferrous ammonium sulfate 0.1 N solution | 0.05 |

Example 3

A formulation was prepared that had the composition shown in Table 3. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, a crockfastness of at least 4, no pilling during abrasive resistance testing, and a stain resistance of at least 3.5.

TABLE 3

Formulation For Printed Cotton Fabric

| | Parts By Weight % |
|---|---|
| Polyamide prepolymer dispersion, Micromid 632MPL (TM) | 10.89 |
| Urethane prepolymer emulsion, Resamine UMT 171 (TM) | 1.80 |
| Acrylic prepolymer, Helastic WD 8061 (TM) | 14.52 |
| Elastomer Latex, Histretch V-43 (TM) | 1.80 |
| H.D. Polyethylene prepolymer, Mykon HD (TM) | 14.52 |
| Modified organopolysiloxane, APS V-soft (TM) | 36.31 |
| Non-ionic dispersant, Crockfast 2 (TM) | 1.80 |
| Deionized water | 18.2 |
| Urethane acrylate, SR-9035 (TM) | 0.04 |
| Polyethylene glycol diacrylate, SR-344 (TM) | 0.04 |
| Urea peroxide 0.1 N solution | 0.04 |
| Ferrous ammonium sulfate 0.1 N solution | 0.04 |

Example 4

A formulation was prepared that had the composition shown in Table 4. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, a crockfastness of at least 4, no pilling during abrasive resistance testing, and a stain resistance of at least 3.5.

TABLE 4

Formulation For Printed Cotton Polyester Fabric

| | Parts By Weight % |
|---|---|
| Acrylic prepolymer, Helastic 8001 (TM) | 11.75 |
| Acrylic prepolymer, Helastic WD 8061 (TM) | 7.83 |
| Acrylic prepolymer, Helastic 8041 (TM) | 1.96 |
| Elastomer Latex, Histretch V-43 (TM) | 1.96 |
| Deionized water | 19.6 |
| Polyamide prepolymer dispersion, Micromid 632MPL (TM) | 1.96 |
| Modified organopolysiloxane, APS V-soft (TM) | 50.9 |
| Carboxylated Butadiene acrylonitrile, Tylac 68805 (TM) | 3.91 |
| Polyethylene glycol diacrylate, SR-344 (TM) | 0.04 |
| Sodium Vinyl Sulfonate | 0.04 |
| Urea peroxide 0.1 N solution | 0.04 |
| Ferrous ammonium sulfate 0.1 N solution | 0.04 |

Example 5

A formulation was prepared that had the composition shown in Table 5. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, no pilling during abrasive resistance testing, and a stain resistance of at least 3.5.

TABLE 5

Formulation for Cotton Fabric

| | Parts By Weight % |
|---|---|
| Glyoxal resin prepolymer, Ecco Res GB 404 (TM) | 5.6 |
| Urethane prepolymer, Resamin UMT171 (TM) | 5.6 |
| High mol. wt. Silicone softener, Helastic WO-8026 (TM) | 1.63 |
| Silicone softener, Sequasoft 69 (TM) | 56.13 |
| Elastomeric Latex, Hystretch V-43 (TM) | 2.80 |
| Fluoroalkyl acrylate copolymer dispersion, Texfluor UPL (TM) | 8.0 |
| Deionized water (DIW) | 19 |
| Urethane acrylate, SR-9035 (TM) | 0.06 |
| Polyethylene glycol diacrylate, SR 344 (TM) | 0.06 |
| Urea peroxide (0.1% in DIW) | 0.06 |
| Ferrous ammonium sulfate solution (0.1 N) | 0.06 |
| Diethylene glycol | 1.0 |

In another composition, the diethylene glycol was replaced with additional water with little degradation of finished fabric properties.

In another composition, the glyoxal resin prepolymer Ecco Res GB 404 (TM) was replaced with glyoxal resin prepolymer Resin KLF (TM) and the formaldehyde in the fabric was reduced below 30 ppm.

Example 6

A formulation was prepared that had the composition shown in Table 6. This formulation was found to, when diluted at ranges from about 2 parts water to 1 part formulation to about 4 parts water to 1 part formulation, and applied to a fabric at a wet pickup of about 60% and dried at a temperature of about 340° F., provide a fabric with good hand, less than 4% shrinkage, no pilling during abrasive resistance testing, and a stain resistance of at least 3.5.

TABLE 6

Formulation For Cotton/Polyester Fabric

| | Parts By Weight |
|---|---|
| Acrylic prepolymer, Helastic 8001 (TM) | 4.86 |
| Urethane prepolymer, Resamine UMT 171 (TM) | 2.43 |
| Acrylic prepolymer, EccoRez 907 (TM) | 2.43 |
| Softener polysiloxane, APS V-soft (TM) | 48.7 |
| Acrylic prepolymer, Helastic WD 8061 (TM) | 14.61 |
| Elastomer Latex, Histretch V-43 (TM) | 2.43 |
| Fluoroalkyl acrylate copolymer dispersion, Texfluor UPL (TM) | 8.0 |
| Deionized water | 16.3 |
| Polyethylene glycol diacrylate, SR344 (TM) | 0.05 |
| Sodium vinyl sulfonate | 0.05 |
| Urea peroxide 0.1 N solution | 0.05 |
| Ferrous ammonium sulfate 0.1 N solution | 0.05 |

Example 7

A formulation was prepared that had the composition shown in Table 7. This formulation was found to, when diluted at ranges from about 2 parts water to 1 part formulation to about 4 parts water to 1 part formulation, and applied to a fabric at a wet pickup of about 80% and dried at a temperature of about 340° F., provide a fabric with excellent stretch and recovery characteristics, as well as good hand, less than 4% shrinkage, no pilling during abrasive resistance testing, and a stain resistance of at least 3.5.

TABLE 7

Formulation For Cotton Fabric

| | Parts By Weight |
|---|---|
| Acrylic prepolymer, Helastic 8001 (TM) | 13.53 |
| Urethane prepolymer, Resamine UMT 171 (TM) | 10.25 |
| High mol. wt. Silicone softener, Helastic WO-8026 (TM) | 8.12 |
| Silicone softener, Sequasoft 69 (TM) | 53.6 |
| Deionized water | 14.21 |
| Polyethylene glycol diacrylate, SR344 (TM) | 0.06 |
| Urethane acrylate, SR-9035 (TM) | 0.06 |
| Urea peroxide 0.1 N solution | 0.06 |
| Ferrous ammonium sulfate 0.1 N solution | 0.06 |

Example 8

Both treated and untreated fabrics were printed with a dye composition and a gum, wherein the gum comprised 99.5% carboxylated butadiene acrylonitrile, 0.04% urethane acrylate, and 0.04% polyethylene glycol diacrylate, and a small quantity of water as a solvent. The fabrics treated with this composition and dried at a temperature sufficient to promote crosslinking, that is, 340° F., were found to have crocking properties at least about 0.5, and as much as 2, units better on a scale of 1 to 5 that similar fabrics dyed with just polyethylene glycol diacrylate and dried at 340° F.

Example 9

A formulation was prepared that had the composition shown in Table 8. This formulation was found to, when diluted at ranges from about 2 parts water to 1 part formulation to about 4 parts water to 1 part formulation, and applied to a fabric at a wet pickup of about 80% and dried at a temperature of about 340° F., provide a fabric with fair stretch and recovery characteristics, as well as good hand, less than 5% shrinkage, no pilling during abrasive resistance testing, good wet crockfastness and acceptable dry crockfastness, and a stain resistance of at least 3.5.

TABLE 8

| | Parts By Weight % |
|---|---|
| Acrylic prepolymer, Helastic 8001 (TM) | 12.9 |
| Deionized water | 25.1 |
| Elastomer Latex, Histretch V-43 (TM) | 1.29 |
| KF (TM) 28/30% in water | 44.08 |
| High mol. wt. Silicone softener, Helastic WO-8026 (TM) | 3.87 |
| Acrylic prepolymer, Helastic WD 8041 (TM) | 2.15 |
| KF 874 (10% in IPA) | 1.29 |
| Aurasoft 280 | 8.6 |
| Sodium vinyl sulfonate | 0.04 |
| Urea peroxide (0.1%) | 0.04 |
| Ferrous ammonium sulfate (0.1%) | 0.04 |

This formulation was tested on cotton navy blotch, and results are in Table 9.

TABLE 9

| | Standard Specs | Actual Finished Specs | 100% sol. Jersey blotch | 100% sol. Jersey blotch Print paste | 50% sol. Jersey blotch | 50% sol. Jersey blotch Print paste |
|---|---|---|---|---|---|---|
| Burst* | 60 | 92 | 112 | 110 | 105 | 105 |
| Oz. Wt. | 6.5 | 6.3 | 7.75 | 7.6 | 7.25 | 7.3 |
| Shrinkage | 7 × 7 | 5.0 × 6.0 | 4.0 × 5.0 | 5.0 × 0 | 4.0 × 4.0 | 4.2 × 0.6 |
| Stretch | 40 | 40 | 42 | 50 | 45 | 45 |
| Recovery | 80 | 97 | 95 | 95 | 95 | 90 |
| Crock W/D | 2.0/3.0 | 2.0/3.0 | 5.0/3.5 | 5.0/3.5 | 5.0/4.0 | 4.5/3.5 |
| Pilling | 3 | 2.0 | 5.0 | 5.0 | 5.0 | 5.0 |

*Mellens' Burst Test

The Mellen's burst test measures the force needed to press a ball, about 1 inch in diameter, through the fabric, which is a measure of the tensile strength of the fabric. As used herein, the tensile strength of the fabric is defined as the force required to push a ball through a fabric following the Mellen test procedures. The strength ratio is the ratio of the force needed to push the ball through the fabric divided by the force needed to push the same ball through similar but untreated fabric. This value is related to sew-ability and wear-ability. Typically, resins applied to cotton lower the tensile strength of a cotton fabric. Applicants have surprisingly found, as shown above, that treatment of the fibers of a fabric increases the strength ratio to 150% (100% being the same strength as untreated fabric) with a large loading of polymer. Smaller loadings increase the strength ratio to 115%, and a preferred loading increases the strength ratio to at least 125%.

Example 10

A formulation was prepared that had the composition shown in Table 10. This formulation was found to, when diluted at ranges from about 2 parts water to 1 part formulation to about 4 parts water to 1 part formulation, and applied to a fabric at a wet pickup of about 80% and dried at a temperature of about 340° F., provide a fabric with excellent stretch and recovery characteristics, as well as good hand, less than 5.4% shrinkage, no pilling during abrasive resistance testing, and excellent crockfastness. The test data on cotton with a navy blotch is shown in Table 11.

TABLE 10

| | Parts By Weight % |
|---|---|
| Urethane prepolymer, Resamine UMT 171 (TM) | 15.42 |
| Polyamide prepolymer dispersion, Micromid 632MPL (TM) | 2.57 |
| Silicone softener, Sequasoft 69 (TM) | 43.18 |
| High mol. wt. Silicone softener, Helastic WO-8026 (TM) | 5.14 |
| Aurasoft 280 (TM) | 7.71 |
| Deionized water | 25.7 |
| Aurawet 634 (TM) | 0.22 |
| Urethane acrylate, SR-9035 (TM) | 0.005 |
| Sodium vinyl sulfonate | 0.005 |
| Sodium Metabisulfite (0.1 N solution) | 0.05 |

TABLE 11

| | Standard Specs | Actual Finished Specs | 100% sol. Jersey blotch | 100% sol. Jersey blotch Print paste | 50% sol. Jersey blotch | 50% sol. Jersey blotch Print paste |
|---|---|---|---|---|---|---|
| Burst* | 60 | 60 | 90 | 92 | 88 | 90 |
| Oz. Wt. | 6.0 | 5.9 | 7.4 | 7.1 | 6.5 | 6.4 |
| Shrinkage | 8 × 8 | 6.0 × 6.0 | 5.4 × 1.0 | 5.0 × 1.5 | 5.0 × 1.5 | 5.2 × 2.0 |
| Stretch | 40 | 40 | 35 | 40 | 30 | 38 |
| Recovery | 80 | 90 | 95 | 95 | 95 | 95 |
| Crock W/D | 2.0/3.0 | 2.0/3.0 | 4.5/4.0 | 4.5/3.5 | 4.5/4.0 | 4.5/4.0 |
| Pilling | 3 | 3 | 5.0 | 5.0 | 5.0 | 5.0 |

*Mellens' Burst Test

Examples 11–13

Three formulations were prepared that had the compositions shown in Table 12, and test data are presented on Table 13. This example shows how sensitive the test results are to minor formulation changes.

TABLE 12

| | Example | | |
|---|---|---|---|
| Ingredients, weight percent | 11 % | 12 % | 13 % |
| Ecco Res GB 404 | 5.0 | 6.5 | 5.6 |
| Urethane prepolymer, Resamine UMT 171 (TM) | 4.8 | 6.8 | 5.6 |
| High mol. wt. Silicone softener, Helastic WO-8026 (TM) | 1.4 | 2.5 | 1.69 |
| Sequasoft V-43 (TM) | 55.0 | 60.0 | 56.13 |
| Elastomer Latex, Histretch V-43 (TM) | 2.33 | 3.5 | 2.80 |

TABLE 12-continued

| Ingredients, weight percent | Example 11 % | 12 % | 13 % |
|---|---|---|---|
| Water | 30.6 | 20.46 | 28.0 |
| Urethane acrylate, SR 9035 (TM) | 0.04 | 0.07 | 0.06 |
| Polyethylene glycol diacrylate SR 344 (TM) | 0.05 | 0.07 | 0.06 |
| Urea peroxide (0.1%) | 0.05 | 0.055 | 0.06 |
| Ferrous ammonium sulfate (0.01) | 0.04 | 0.045 | 0.06 |

TABLE 13

| Example | 11 | 12 | 13 |
|---|---|---|---|
| Burst | 83 | 112 | 92 |
| Oz. wt. | 5.64 | 7.5 | 6.9 |
| Shrinkage % | 7 × 5 | 6 × 5 | 3.8 × 3.1 |
| Stretch % | 40 | 30 | 55 |
| Recovery % | 97 | 98 | 95 |
| Crock Wet/Dry | 5/5 | 2/4 | 4/4.5 |
| Pilling | 3.5 | 4 | 5 |
| Hand | Medium soft | Soft | Very Soft |

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. A method for making a fiber with a soft hand and good crock-fastness, color-fastness, abrasion resistance, and stain resistance, which comprises:

contacting a cellulosic fiber with a graft initiator;

contacting the cellulosic fiber with a composition comprising:

an organopolysiloxane, a polymerizable silicon oil, or a mixture thereof;

a first polymerizable prepolymer; and a second polymerizable prepolymer, wherein the composition is stable with less than 5% of the polymerizable material self-polymerizing at a temperature of between about 60° F. and 90° F. during storage over a period of at least 2 months; and forming a grafted copolymer onto the cellulosic fiber substrate, said grafted copolymer comprising at least about 10% by weight of the organopolysiloxane or the polymerized silicon oil.

2. The method of claim 1 wherein the grafted polymers comprise between about 2% and about 10% by weight of the fiber, wherein at least about half of the grafted polymers remain after 15 wash cycles, and wherein the strength of fabric made of the grafted fiber is at least 115% of the strength of fabric made of ungrafted fiber.

3. The method of claim 1 wherein the composition comprises between about 3% to about 35% by weight of an aqueous silicone oil emulsion, an aqueous organopolysiloxane emulsion, or a mixture thereof, and further comprises a graft initiator.

4. The method of claim 3 wherein the composition comprises between about 6% to about 35% by weight of an aqueous silicone oil emulsion, an aqueous organopolysiloxane emulsion, or a mixture thereof, and wherein the graft initiator comprises a salt of Fe, Ag, Co, Cu, or mixtures thereof.

5. The method of claim 1 wherein the composition comprises:

between about 6% and about 35% of an aqueous silicone oil emulsion;

between about 0.2% and about 5% of a urethane prepolymer emulsion which is the first polymerizable prepolymer;

between about 0.4% and about 5% of a glyoxal prepolymer which is the second polymerizable prepolymer: and further comprises between about 0.1% and about 3% of an elastomeric latex prepolymer:

between about 0.002% and about 0.3% of a catalyst; and between about 0.002% and about 0.3% of a graft initiator, wherein the solids content of the stable composition upon drying is at least about 5% by weight; wherein the contacting provides between about 40 grams and about 120 grams of the stable composition to about 100 grams of fibers; and wherein the grafted polymer is formed by exposure to a temperature sufficient for polymerization of polymers grafted onto the fiber.

6. The method of claim 5 wherein the stable composition further comprises: between about 0.02% and about 2% of a high molecular weight organosilicone suspension;

between about 0.002% and about 0.15% of a urethane acrylate prepolymer;

between about 0.002% and about 0.15% of a polyethylene glycol diacrylate; and between about 0.004% and about 2% of a polyethylene glycol.

7. The method of claim 5 wherein the stable composition comprises:

between about 0.8% and about 3.5% of a glyoxal prepolymer;

between about 0.2% and about 2% of an elastomeric latex prepolymer;

between about 8% and about 30% of an aqueous silicone oil emulsion;

between about 0.8% and about 4% of a urethane prepolymer emulsion; and between about 0.006% and about 0.2% of a graft initiator;

wherein the contacting picks-up between about 60 grams and about 100 grams of the stable composition to about 100 grams of cotton fibers; and wherein the temperature is between about 250° F. and 400° F. for between about 10 seconds and 10 minutes.

8. The method of claim 7 wherein the stable composition further comprises: between about 0.1% and about 1.5% of a high molecular weight organosilicone suspension;

between about 0.006% and about 0.2% of a catalyst;

between about 0.004% and about 0.08% of a urethane acrylate prepolymer;

between about 0.004% and about 0.08% of a polyethylene glycol diacrylate; and between about 0.1% and about 1% of a polyethylene glycol.

9. The method of claim 8 wherein the fiber comprises dyed cotton, and the stable composition comprises:

between about 1% and about 3% of a glyoxal prepolymer;

between about 0.4% and about 1.5% of an elastomeric latex prepolymer;

between about 10% and about 30% of an aqueous silicone oil emulsion;

between about 1% and about 3.5% of a urethane prepolymer emulsion;

between about 0.2 and about 1% of a high molecular weight organosilicone suspension;

between about 0.01% to about 0.05% of a urethane acrylate prepolymer;

between about 0.01% to about 0.05% of a polyethylene glycol diacrylate;

between about 0.01% and about 0.05% of a catalyst;

between about 0.01% and about 0.05% of a graft initiator; and between about 0.16% to about 0.8% of a polyethylene glycol.

10. The method of claim 5 wherein the stable composition is provided by admixing between about 4 parts and about 50 parts of a stable concentrated composition comprising:

between about 2% and about 10% of a glyoxal prepolymer;

between about 0.5% and about 6% of an elastomeric latex prepolymer;

between about 30% and about 70% of an aqueous silicone oil emulsion;

between about 1% and about 10% of a urethane prepolymer emulsion;

between about 0.01% to about 0.6% of a catalyst;

between about 0.01% to about 0.6% of a graft initiator;

with a solvent comprising water to form 100 parts of the stable composition; wherein the concentrated composition is a stable fluid with less than 5% of the prepolymers self-polymerizing at a temperature of between about 60° F. and 90° F. during storage over a period of at least 2 months, and wherein the stable concentrated composition comprises between about 10% and about 35% solids when dried.

11. The method of claim 10 wherein the stable concentrated composition further comprises:

between about 0.1% and about 4% of a high molecular weight organosilicone suspension;

between about 0.01% and about 0.3% of a urethane acrylate prepolymer;

between about 0.2% and about 4% of a polyethylene glycol; and between about 0.01% and about 0.3% of a polyethylene glycol diacrylate.

12. The method of claim 10 wherein the stable concentrated composition comprises:

between about 4% and about 7% of a glyoxal prepolymer;

between about 1% and about 4% of an elastomeric latex prepolymer;

between about 40% and about 60% of an aqueous silicone oil emulsion;

between about 4% and about 8% of a urethane prepolymer emulsion;

between about 0.03% and about 0.2% of a catalyst; and between about 0.03% and about 0.2% of a graft initiator; wherein the stable concentrated composition comprises between about 20% and about 32% solids when dried.

13. The method of claim 12 wherein the stable concentrated composition further comprises:

between about 0.5% and about 3% of a high molecular weight organosilicone suspension;

between about 0.02% and about 0.15% of a urethane acrylate prepolymer;

between about 0.5% to about 2% of a polyethylene glycol; and between about 0.02% and about 0.15% of a polyethylene glycol diacrylate.

14. The method of claim 13 wherein the stable concentrated composition comprises:

between about 5% and about 6% of a glyoxal prepolymer;

between about 2% and about 3% of an elastomeric latex prepolymer;

between about 52% and about 60% of an aqueous silicone oil emulsion;

between about 5% and about 7% of a urethane prepolymer emulsion;

between about 0.03% to about 0.1% of a catalyst;

between about 0.03% to about 0.1% of a graft initiator;

between about 1% and about 2% of a high molecular weight organosilicone suspension;

between about 0.04% to about 0.1% of a urethane acrylate prepolymer;

between about 0.04% to about 0.1% of a polyethylene glycol diacrylate; and between about 0.6% to about 1.6% of a polyethylene glycol; wherein the stable concentrated composition comprises between about 25% and about 30% solids when dried.

15. The method of claim 5 wherein the graft initiator comprises salts of Fe, Ag, Co, Cu, or mixtures thereof; wherein the catalyst comprises a peroxide, peracid, perbenzoate, metabisulfite, or mixtures thereof, and wherein the glyoxal prepolymer is a low-formaldehyde prepolymer such that the polymer forms less than 30 ppm formaldehyde in treated fiber.

16. The method of claim 5 wherein the stable composition further comprises between about 0.4% and about 8% of a fluoroalkyl acrylate suspension.

17. The method of claim 6 wherein the cotton fiber comprises undyed cotton, and the stable composition further comprising between about 0.4% and about 8% of a fluoroalkyl acrylate suspension.

18. The method of claim 8 wherein the stable composition further comprises between about 0.8% and about 6% of a fluoroalkyl acrylate suspension.

19. The method of claim 10 wherein the cotton fiber comprises undyed cotton, and the concentrated stable composition further comprising between about 2% and about 16% of a fluoroalkyl acrylate suspension.

20. The method of claim 12 wherein the cotton fiber comprises undyed cotton, and the concentrated stable composition further comprising between about 6% and about 9% of a fluoroalkyl acrylate suspension.

21. The product of the process of claim 5.

22. The composition of claim 9.

23. The concentrated composition of claim 10.

24. The stable concentrated composition of claim 23 comprising:

between about 5% and about 6% of a glyoxal prepolymer;

between about 2% and about 3% of an elastomeric latex prepolymer;

between about 52% and about 60% of an aqueous silicone oil emulsion;

between about 5% and about 7% of a urethane prepolymer emulsion;

between about 0.01% to about 0.2% of a catalyst;

between about 0.01% to about 0.2% of a graft initiator;

between about 1% and about 2% of a high molecular weight silicone;

between about 0.04% to about 0.1% of a urethane acrylate prepolymer; and between about 0.04% to about 0.1% of a polyethylene glycol diacrylate; and between about 0.8% to about 1.2% of a polyethylene glycol.

25. The method of claim 5 wherein the stable fluid composition comprises:

between about 1.6% and about 18% of acrylic prepolymer which is the first polymerizable prepolymer;

between about 0.1% and about 3% of an elastomeric latex prepolymer which is the second polymerizable prepolymer;

between about 6% and about 35% of an organopolysiloxane emulsion; and further comprises between about 0.1% and about 3% of a urethane prepolymer emulsion; and between about 0.002% and about 0.3% of a graft initiator, wherein the composition is stable with less than 5% of the prepolymers self-polymerizing at a temperature of between about 60° F. and 90° F. during storage over a period of at least 2 months, and wherein the solids content of the stable composition upon drying is at least about 5% by weight;

wherein in contacting the fibers pick-up between about 40 grams and about 120 grams of the stable composition to about 100 grams of fibers; and wherein the grafted polymer is formed by exposure to a temperature sufficient for polymerization of polymers grafted onto the fiber.

26. The method of claim 25 wherein the stable composition further comprises:

between about 0.002% and about 0.3% of a catalyst;

between about 0.002% and about 0.2% of a polyethylene glycol diacrylate; and between about 0.002% and about 0.2% of a surfactant monomer.

27. The method of claim 25 wherein the fiber comprises a cotton/polyester blend, and the stable composition comprises:

between about 3.2% and about 15% of acrylic prepolymer;

between about 0.2% and about 2% of an elastomeric latex prepolymer;

between about 8% and about 30% of an organopolysiloxane emulsion;

between about 0.2% and about 2% of a urethane prepolymer emulsion;

between about 0.004% and about 0.1% of a catalyst;

between about 0.004% and about 0.1% of a graft initiator;

wherein the contacting picks-up between about 60 grams and about 100 grams of the stable composition to about 100 grams of cotton/polyester fibers; and wherein the temperature is between about 250° F. and 400° F. and the time is between about 10 seconds and 10 minutes.

28. The method of claim 27 wherein the stable composition further comprises:

between about 0.004% and about 0.1% of a polyethylene glycol diacrylate; and between about 0.002% and about 0.2% of a surfactant monomer.

29. The method of claim 28 wherein the stable composition comprises:

between about 4% and about 12% of acrylic prepolymer;

between about 0.4% and about 1.5% of an elastomeric latex prepolymer;

between about 9% and about 26% of an organopolysiloxane emulsion;

between about 0.4% and about 1.5% of a urethane prepolymer emulsion;

between about 0.006% and about 0.05% of a catalyst;

between about 0.006% and about 0.05% of a graft initiator;

between about 0.006% and about 0.05% of a polyethylene glycol diacrylate; and between about 0.006% and about 0.05% of a surfactant monomer.

30. The method of claim 25 wherein the stable composition is provided by admixing between about 4 grams and about 50 grams of a stable concentrated composition comprising:

between about 8% and about 35% of acrylic prepolymer;

between about 0.5% and about 6% of an elastomeric latex prepolymer;

between about 30% and about 70% of an organopolysiloxane emulsion;

between about 0.5% and about 6% of a urethane prepolymer emulsion;

between about 0.01% and about 0.4% of a catalyst;

between about 0.01% and about 0.4% of a graft initiator, wherein the concentrated composition is stable with less than 5% of the prepolymers self-polymerizing at a temperature of between about 60° F. and 90° F. during storage over a period of at least 2 months, and wherein the stable concentrated composition comprises between about 10% and about 35% solids when dried;

with a solvent comprising water to form 100 grams of the stable composition.

31. The method of claim 30 wherein the stable concentrated composition further comprises:

between about 0.01% and about 0.4% of a polyethylene glycol diacrylate; and between about 0.01% and about 0.4% of a surfactant monomer.

32. The method of claim 30 wherein the stable concentrated composition comprises:

between about 16% and about 30% of acrylic prepolymer;

between about 1% and about 4% of an elastomeric latex prepolymer;

between about 38% and about 60% of an organopolysiloxane emulsion;

between about 1% and about 4% of a urethane prepolymer emulsion;

between about 0.02% and about 0.2% of a catalyst;

between about 0.02% and about 0.2% of a graft initiator, wherein the stable concentrated composition comprises between about 25% and about 32% solids when dried.

33. The method of claim 31 wherein the stable concentrated composition comprises:

between about 20% and about 24% of acrylic prepolymer;

between about 2% and about 3% of an elastomeric latex prepolymer;

between about 46% and about 52% of an organopolysiloxane emulsion;

between about 2% and about 3% of a urethane prepolymer emulsion;

between about 0.03% and about 0.1% of a catalyst;

between about 0.03% and about 0.1% of a polyethylene glycol diacrylate;

between about 0.03% and about 0.1% of a surfactant monomer; and between about 0.03% and about 0.1% of a graft initiator, wherein the stable concentrated composition comprises between about 25% and about 30% solids when dried.

34. The method of claim 25 wherein the graft initiator comprises salts of Fe, Ag, Co, Cu, or mixtures thereof and wherein the catalyst comprises a peroxide, peracid, perbenzoate, metabisulfite.

35. The method of claim 25 wherein the stable composition further comprises between about 0.4% and about 8% of a fluoroalkyl acrylate.

36. The method of claim 27 wherein the cotton/polyester fiber comprises undyed cotton/polyester fiber, the stable composition further comprising between about 0.8% and about 6% of a fluoroalkyl acrylate.

37. The method of claim 33 wherein the stable composition further comprises between about 1.2% and about 4.5% of a fluoroalkyl acrylate.

38. The method of claim 30 wherein the cotton/polyester fiber comprises undyed cotton/polyester fiber, the concentrated stable composition further comprising between about 2% and about 16% of a fluoroalkyl acrylate.

39. The method of claim 32 wherein the cotton/polyester fiber comprises undyed cotton/polyester fiber, the concentrated stable composition further comprising between about 6% and about 9% of a fluoroalkyl acrylate.

40. The product of the process of claim 25.

41. The stable concentrated aqueous composition of claim 25.

42. The stable concentrated aqueous composition of claim 30.

43. The stable concentrated aqueous composition of claim 38.

44. The method of claim 1 further comprising the steps of contacting fiber with a printing composition comprising a pigment, an adhesive gum, a solvent, and between about 0.01% to about 2% of at least one polymerizable prepolymer; and causing the printing composition prepolymer to polymerize, thereby adhering the pigment to the fiber such that the crockfastness of the pigment is superior to the crockfastness of a fiber treated with a printing composition consisting essentially of the adhesive gum and the pigment.

45. The method of claim 1 which further comprises contacting the filaments or yarns with a solution of the first component by a dipping, spraying, or coating operation.

46. The method of claim 1 wherein the composition also comprises one or more of viscosity control agents, perfumes, emulsifiers, preservatives, UV light absorbers, antioxidants, bactericides, fungicides, colorants, dyes, fluorescent dyes, brighteners, opacifiers, wettability modifiers, soil release agents, flame retardant, and shrinkage control agents.

47. The method of claim 46 wherein the wettability modifier is a polymerizable prepolymer in a quantity sufficient to make the fiber more hydrophobic than a fiber treated with a composition not including the wettability modifier.

48. The method of claim 46 wherein the wettability modifier is a polymerizable prepolymer in a quantity sufficient to make the fiber more hydrophillic than a fiber treated with a composition not including the wettability modifier.

49. The method of claim 48 wherein the wettability modifier is a polymerizable prepolymer containing an sulfonate, sulfate, or carboxyl moiety.

50. The method of claim 46 wherein the bactericide is a polymerizable prepolymer in a quantity sufficient to make the fiber more resistant to bacterial growth than a fiber treated with a composition not including the bactericide.

51. The method of claim 50 wherein the bactericide is a polymerizable prepolymer containing protonated amine.

52. The method of claim 46 wherein the flame retardant agent is a polymerizable prepolymer in a quantity sufficient to make the fiber more resistant to supporting a flame than a fiber treated with a composition not including the flame retardant agent.

53. The method of claim 52 wherein the flame retardant agent is a polymerizable prepolymer containing chlorine or bromine.

54. The product of the process of claim 5 wherein the cellulosic fiber comprises cotton, wherein the product contains at least 2% by weight of grafted copolymer, at least about half of the grafted copolymers remain after 15 wash cycles, and wherein the strength ratio compared of fabric made of the grafted fiber is at least 115% compared to of the strength of fabric made of ungrafted fiber.

55. The product of the process of claim 25 wherein the cellulosic fiber comprises cotton, wherein the product contains at least 2% by weight of grafted copolymer, at least about half of the grafted copolymers remain after 15 wash cycles, and wherein the strength ratio compared of fabric made of the grafted fiber is at least 115% compared to of the strength of fabric made of ungrafted fiber.

* * * * *